US009452765B2

(12) United States Patent
Nibouar et al.

(10) Patent No.: US 9,452,765 B2
(45) Date of Patent: Sep. 27, 2016

(54) RAILCAR COUPLER CORE WITH VERTICAL PARTING LINE AND METHOD OF MANUFACTURE

(71) Applicant: Bedloe Industries LLC, Wilmington, DE (US)

(72) Inventors: F. Andrew Nibouar, Chicago, IL (US); Jerry R. Smerecky, South Barrington, IL (US); Kelly S. Day, Sparta, MI (US); Vaughn Makary, Muskegon, MI (US); Nick Salamasick, Nunica, MI (US)

(73) Assignee: Bedloe Industries LLC, Wilmington, DE (US)

( * ) Notice: Subject to any disclaimer, the term of this patent is extended or adjusted under 35 U.S.C. 154(b) by 0 days.

(21) Appl. No.: 14/921,622

(22) Filed: Oct. 23, 2015

(65) Prior Publication Data

US 2016/0107659 A1 Apr. 21, 2016

Related U.S. Application Data

(63) Continuation of application No. 14/269,392, filed on May 5, 2014, now Pat. No. 9,187,102, which is a continuation of application No. 13/112,926, filed on May 20, 2011, now Pat. No. 8,720,711.

(51) Int. Cl.

| | |
|---|---|
| ***B61G 7/00*** | (2006.01) |
| ***B61G 3/04*** | (2006.01) |
| ***B22C 7/06*** | (2006.01) |

(Continued)

(52) U.S. Cl.

CPC . *B61G 7/00* (2013.01); *B22C 7/06* (2013.01); *B22C 9/10* (2013.01); *B22C 9/103* (2013.01); *B22D 25/02* (2013.01); *B61G 3/04* (2013.01)

(58) Field of Classification Search

CPC ..... B61G 7/00; B61G 3/00; B61G 3/04; B61G 3/06; B22C 7/06; B22C 9/10; B22C 9/103; B22C 9/02; B22C 9/22; B22C 21/14; B22C 13/12

USPC ..... 213/75 R, 155, 118, 140, 152, 156

See application file for complete search history.

(56) References Cited

U.S. PATENT DOCUMENTS

| | | | | |
|---|---|---|---|---|
| 2,088,135 A * | 7/1937 | Johnson | B61G 3/04 213/155 |
| 2,617,540 A * | 11/1952 | Metzger | B61G 3/04 213/155 |
| 2,688,412 A * | 9/1954 | Kulieke | B22C 9/00 213/155 |

(Continued)

FOREIGN PATENT DOCUMENTS

| | | |
|---|---|---|
| CN | 101402131 A | 4/2009 |
| GB | 743098 A | 1/1956 |

(Continued)

OTHER PUBLICATIONS

Aug. 30, 2012—(WO) International Search Report and Written Opinion—App. PCT/US2012/037907.

(Continued)

*Primary Examiner* — Jason C Smith

(74) *Attorney, Agent, or Firm* — Banner & Witcoff, Ltd.

(57) ABSTRACT

A method of casting a core includes the steps of preparing a first half of a corebox, preparing a second half of a corebox such that the parting line of a core formed from the first and second coreboxes runs along the vertical axis of the core.

17 Claims, 20 Drawing Sheets

(51) Int. Cl.
*B22C 9/10* (2006.01)
*B22D 25/02* (2006.01)

(56) References Cited

U.S. PATENT DOCUMENTS

| | | | | | |
|---|---|---|---|---|---|
| 2,769,556 | A * | 11/1956 | Metzger | B61G 3/04 | 213/127 |
| 2,909,293 | A * | 10/1959 | Metzger | B61G 3/06 | 213/146 |
| 2,997,755 | A * | 8/1961 | Olson | B22C 17/00 | 164/232 |
| 3,854,599 | A * | 12/1974 | Day | B61G 3/04 | 213/100 R |
| 4,024,958 | A * | 5/1977 | Kaufhold | B61G 3/06 | 213/151 |
| 4,143,701 | A * | 3/1979 | Oshinsky | B22C 9/103 | 164/368 |
| 4,206,849 | A * | 6/1980 | Kaim | B61G 3/06 | 213/109 |
| 4,605,133 | A * | 8/1986 | Altherr | B61G 3/00 | 213/109 |
| 4,811,854 | A * | 3/1989 | Elliott | B61G 3/04 | 213/155 |
| 4,976,363 | A * | 12/1990 | Altherr | B61G 3/06 | 213/155 |
| 5,479,981 | A * | 1/1996 | Kim | B22D 25/02 | 164/132 |
| 5,582,307 | A * | 12/1996 | Hawthorne | B22C 9/02 | 213/109 |
| 5,915,451 | A * | 6/1999 | Nakamura | B22C 13/12 | 164/165 |
| 5,916,451 | A | 6/1999 | Perfecto et al. | | |
| 5,954,212 | A * | 9/1999 | Beatty | B61G 3/04 | 213/109 |
| 6,129,227 | A * | 10/2000 | Openchowski | B61G 3/04 | 213/111 |
| 6,588,490 | B2 * | 7/2003 | Rommel | B22C 9/103 | 164/339 |
| 7,302,994 | B2 | 12/2007 | Mautino et al. | | |
| 8,201,613 | B2 | 6/2012 | Marchese et al. | | |
| 2002/0007931 | A1 * | 1/2002 | Crafton | B22D 15/00 | 164/127 |
| 2005/0184021 | A1 * | 8/2005 | Mautino | B22C 9/103 | 213/118 |
| 2007/0125510 | A1 * | 6/2007 | Mautino | B22C 9/02 | 164/137 |
| 2008/0083690 | A1 | 4/2008 | Mautino et al. | | |
| 2009/0289023 | A1 * | 11/2009 | Marchese | B61G 3/04 | 213/155 |
| 2009/0289024 | A1 * | 11/2009 | Nibouar | B61G 3/04 | 213/75 R |
| 2009/0294395 | A1 * | 12/2009 | Smerecky | B22C 9/02 | 213/155 |
| 2012/0228256 | A1 | 9/2012 | Marchese et al. | | |
| 2012/0292280 | A1 * | 11/2012 | Nibouar | B61G 3/04 | 213/155 |
| 2012/0292282 | A1 * | 11/2012 | Nibouar | B61G 7/00 | 213/155 |
| 2014/0319092 | A1 * | 10/2014 | Nibouar | B61G 3/04 | 213/155 |

FOREIGN PATENT DOCUMENTS

| | | | | |
|---|---|---|---|---|
| GB | 2292899 | A | 3/1996 | |
| GB | 2300611 | A | 11/1996 | |
| WO | 2009142748 | A1 | 11/2009 | |
| WO | 2009142750 | A1 | 11/2009 | |
| WO | 2009142757 | A1 | 11/2009 | |
| WO | WO 2009142748 | A1 * | 11/2009 | B22C 9/10 |
| WO | WO 2009142757 | A1 * | 11/2009 | B22C 9/02 |
| WO | 2012162029 | A1 | 11/2012 | |
| WO | 2012162030 | A1 | 11/2012 | |

OTHER PUBLICATIONS

Aug. 30, 2012—(WO) International Search Report and Written Opinion—PCT/US2012/037879.
Aug. 30, 2012—(WO) International Search Report and Written Opinion—App. PCT/US2012/037952.
Aug. 30, 2012—(WO) International Search Report and Written Opinion—App. PCT/US2012/037949.
May 30, 2011—(WO) International Search Report and Written Opinion—App. PCT/US2010/062574.
Mar 30, 2015—(US) Office Action—U.S. Appl. No. 14/269,392.
Sep. 2, 2015—(CN) Office Action—App. 201280003842.1.

* cited by examiner

RAILCAR COUPLER CORE WITH VERTICAL PARTING LINE AND METHOD OF MANUFACTURE

CROSS-REFERENCE TO RELATED APPLICATIONS

This application is a continuation of pending U.S. application Ser. No. 14/269,392 filed May 5, 2014 entitled "Railcar Coupler core with Vertical Parting Line and Method of Manufacture", which is a continuation of U.S. Pat. No. 8,720,711 issued May 13, 2014 entitled "Railcar Coupler Core with Vertical Parting Line and Method of Manufacture" all of which are incorporated by referenced.

FIELD OF INVENTION

The present invention relates generally to the field of railroad couplers, and more specifically to the cores used to produce the interior spaces of the knuckle of railroad couplers and the methods used to produce these cores, as well as the structure of the knuckle itself and its method of production.

BACKGROUND

Railcar couplers are disposed at each end of a railway car to enable joining one end of such railway car to an adjacently disposed end of another railway car. The engageable portions of each of these couplers are known in the railway art as knuckles. For example, railway freight car coupler knuckles are taught in U.S. Pat. Nos. 4,024,958; 4,206,849; 4,605,133; and 5,582,307.

Coupler knuckles are generally manufactured from a cast steel using a mold and three cores that produce the interior spaces of the knuckles. These three cores typically make up the rear core or "kidney" section, the middle core or "C-1 O" or "pivot pin" section, and the front core or "finger" section. During the casting process itself the interrelationship of the mold and three cores disposed within the mold is critical to producing a satisfactory railway freight car coupler knuckle.

The most common technique for producing these components is through sand casting. Sand casting offers a low cost, high production method for forming complex hollow shapes such as coupler bodies, knuckles, side frames and bolsters. In a typical sand casting operation, (1) a mold is formed by packing sand around a pattern, which generally includes the gating system; (2) The pattern is removed from the mold; (3) cores are placed into the mold, which is closed; (4) the mold is filled with hot liquid metal through the gating; (5) the metal is allowed to cool in the mold; (6) the solidified metal, referred to as raw casting is removed by breaking away the mold; (7) and the casting is finished and cleaned which may include the use of grinders, welders, heat treatment, and machining.

In a sand casting operation, the mold is created using sand as a base material, mixed with a binder to retain the shape. The mold is created in two halves—cope (top) and drag (bottom) which are separated along the parting line. The sand is packed around the pattern and retains the shape of the pattern after it is extracted from the mold. Draft angles are machined into the pattern to ensure the pattern releases from the mold during extraction. In some sand casting operations, a flask is used to support the sand during the molding process through the pouring process. Cores are inserted into the mold and the cope is placed on the drag to close the mold.

When casting a complex or hollow part, cores are used to define the hollow interior, or complex sections that cannot otherwise be created with the pattern. These cores are typically created by mixing sand and binder together and then filling a box shaped as the feature being created with the core. These core boxes are either manually packed or created using a core blower. The cores are removed from the box, and placed into the mold. The cores are located in the mold using core prints to guide the placement, and prevent the core from shifting while the metal is poured. Additionally, chaplets may be used to support or restrain the movement of cores, and fuse into the base metal during solidification.

The mold typically contains the gating system which provides a path for the molten metal, and controls the flow of metal into the cavity. This gating consists of a down sprue, which controls metal flow velocity, and connects to the runners. The runners are channels for metal to flow through the gates into the cavity. The gates can control flow rates into the cavity, and prevent turbulence of the liquid.

After the metal has been poured into the mold, the casting cools and shrinks as it approaches a solid state. As the metal shrinks, additional liquid metal must continue to feed the areas that contract, or voids will be present in the final part. In locations with heavy thick metal sections, risers are placed in the mold to provide a secondary reservoir of liquid metal. These risers are the last areas to solidify, and thereby allow the contents to remain in the liquid state longer than the cavity or the part being cast. As the contents of the cavity cool, the risers feed the areas of contraction, ensuring a solid final casting is produced. Risers that are open on the top of the cope mold can also act as vents for gases to escape during pouring and cooling.

In the various casting techniques, different sand binders are used to allow the sand to retain the pattern shape. These binders have a large effect on the final product, as they control the dimensional stability, surface finish, and casting detail achievable in each specific process. The two most typical sand casting methods include (1) green sand, consisting of silica sand, organic binders and water; and (2) no-bake or air set consisting of silica sand and fast curing chemical adhesives. Traditionally, coupler bodies and knuckles have been created using the green sand process, due to the lower cost associated with the molding materials. While this method has been effective at producing these components for many years, there are disadvantages to this process.

Many knuckles fail from internal and/or external inconsistencies in the metal through the knuckle. These inconsistencies can be caused when one or more cores move during the casting process, creating variances in the thickness of the knuckle walls. These variances can result in offset loading and increased failure risk during use of the knuckle.

Traditionally, each of the three cores needed to be set in a separate print in the mold which helps maintain each core's position. Furthermore, additional support mechanisms, such as manually inserted nails, are necessary to avoid shifting. These techniques are labor intensive and allow for human error.

Earlier designs may also allow turbulence in the flow of molten steel during the pour due to the sharp transitions in certain areas. When metal fills the molds under high velocity, it creates turbulence. Any sharp or abrupt transition in the molds or cores also creates turbulence, and/or pressure gradients that can also cause the cores to shift. Furthermore, the turbulence and pressure gradients can cause mold erosion, inclusions and reoxidation defects. These problems can cause solidification issues such as shrinkage and porosity, which in turn can lead to knuckle failure.

The issues above can all result in casting inconsistencies in the knuckle core surfaces. The ramifications of such inconsistencies and the low fatigue strength of the resulting parts can be extremely expensive, as The Association of American Railroads (AAR) has strict standards as to when a part must be scrapped and replaced. The 2011 Field Manual of the AAR notes at Rule 16, Section A, that "knuckles found broken or with cracks in any area . . . determined by visual inspection and/or by utilizing non-destructive testing as defined in AAR Specification M-220 shall be scrapped. (emphasis added). Due to these strict standards, and the expense of replacing these parts in the field, there is an ongoing need to improve the strength and/or fatigue life in coupler knuckles as well as a need to improve the design of the cores used to form the knuckles.

SUMMARY OF INVENTION

In a first embodiment a method of casting a core includes the steps of preparing a first half of a corebox, preparing a second half of a corebox such that the parting line of a core formed from the first and second coreboxes runs along the vertical axis of the core.

In a second embodiment a core for forming the interior spaces of a railcar part, said core includes a parting line along the vertical axis of the part.

In a third embodiment a railcar coupler knuckle has a top knuckle pulling lug with a wall thickness of between about 0.47"-0.53" throughout the entire top knuckle pulling lug.

In a fourth embodiment a railcar coupler knuckle has a top knuckle pulling lug with a wall thickness that has a substantially constant thickness from the top of the front face of the top knuckle pulling lug to the bottom face of the top knuckle pulling lug.

BRIEF DESCRIPTION OF THE DRAWINGS

The system may be better understood with reference to the following drawings and description. The components in the figures are not necessarily to scale, emphasis instead being placed upon illustrating the principles of the invention. Moreover, in the figures, like-referenced numerals designate corresponding parts throughout the different views. Furthermore, measurements shown in the figures are examples only, and are not meant to limit the breadth of the claims.

A first goal of the present invention is to reduce core shifting during casting and therefore improve the strength and fatigue life of a coupler knuckle by utilizing two cores that include a unique interlock feature. A completed knuckle 10 is shown in FIGS. 1-3 for reference. By way of background, the general parts of the completed knuckle will be recited here referring to FIGS. 1-3. A knuckle 10 has a buffing shoulder 12, a C-10 pin hole 14, a flag hole 16, a front face 18, a heel 20, a hub 22, a lock shelf 24, a locking face 26, a nose 28, a pin protector 30, a pulling face 32, a pulling lug 34, a spine 36, a spine transition 38, a tail 40, a tail stop 42, a thrower pad 44 and a throat 46. Referring to FIG. 4, the first specialized core is a finger core 48 which forms the spaces in the front face 18 side of the knuckle 10, and the second specialized core is a combination C-10/kidney core 50, which forms the spaces in the C-10 pinhole 14 and tail 40 sections of the knuckle 10.

With respect to the front portion of the knuckle 10, the present invention utilizes a uniquely shaped first core referred to as a finger core 48, shown in FIGS. 4-8. FIGS. 5, 6 and 7 show the finger core 48 connected to the kidney core 50. FIG. 4 shows the finger core 48 about to be connected to the second, or C-10/kidney core, through the interaction of a lug 52 defined on a wall 54 of the finger core 48 and a slot 56 defined on a first wall 58 that forms a wall of the C-10 portion 60 of the C-10/kidney core 50. FIG. 8 shows the finger core 48 alone.

Figure 1:
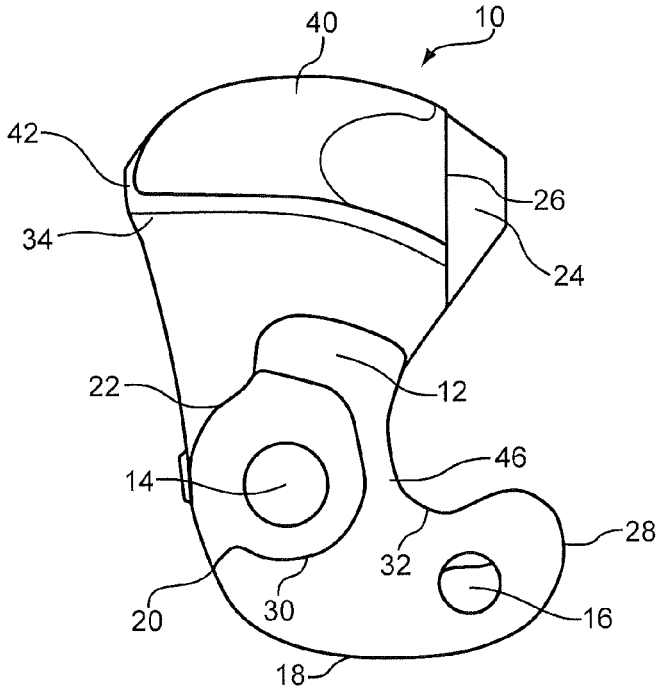
FIG. 1 shows a top view of a completed knuckle.
Figure 2:
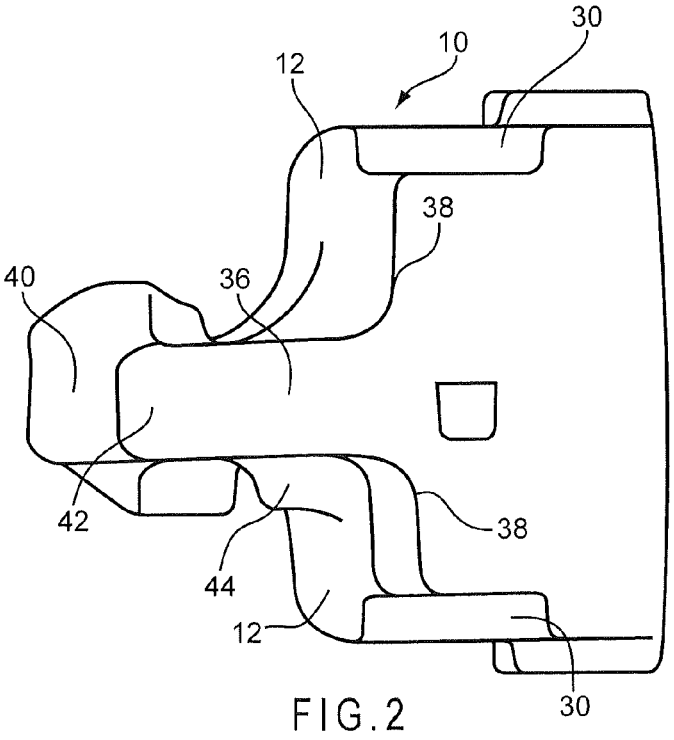
FIG. 2 shows a side view of a completed knuckle.
Figure 3B:
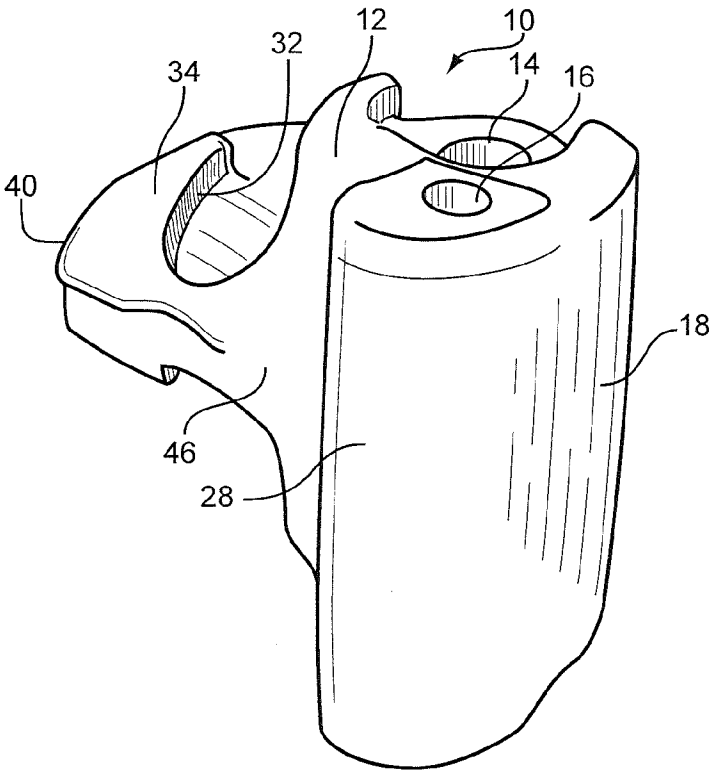
FIG. 3B shows a perspective view of a completed knuckle from the opposite side of FIG. 3A.
Figure 3A:
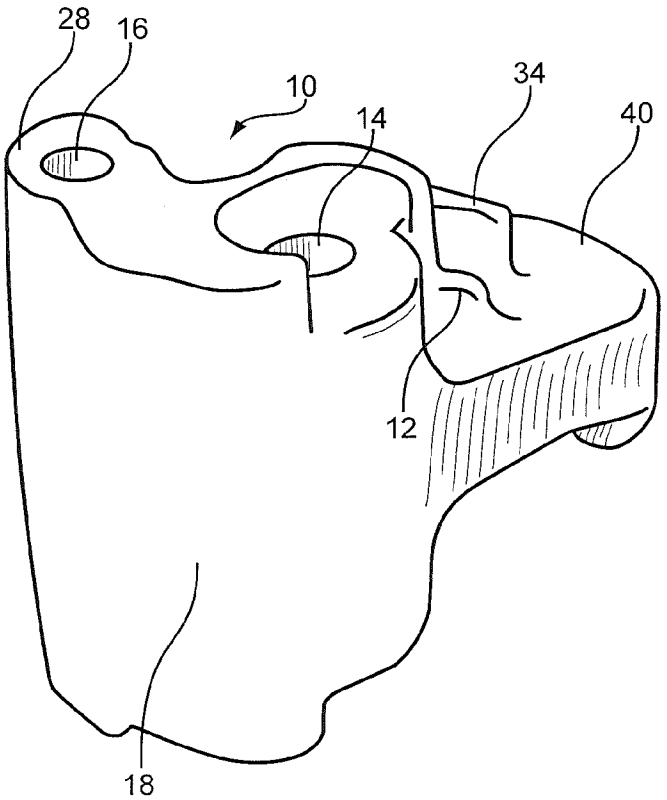
FIG. 3A shows a perspective view of a completed knuckle.

Referring again to FIGS. 5, 7 and 14, the design of the lug 52 and slot 56 form an interlock feature, or first transition section 62, between the cores 48, 50 that forms a smooth transition from the kidney/C-10 core 50 to the finger core 48 in the transition section 62. The advantage of this smooth transition section 62 is that it reduces the turbulence of the molten metal during the casting process which in turn reduces solidification issues such as inclusions, reoxidation defects and porosity in the metal, and reduces the possibility of mold erosion. This feature also reduces the occurrence of hot tears on the inside features of the knuckle 10, which is a problem in existing castings. Furthermore, it results in much greater control of the dimensions between the C-10 pin hole 14 and the pulling lugs 34 and buffing shoulders 12 of the completed knuckle 10.

Figure 11:
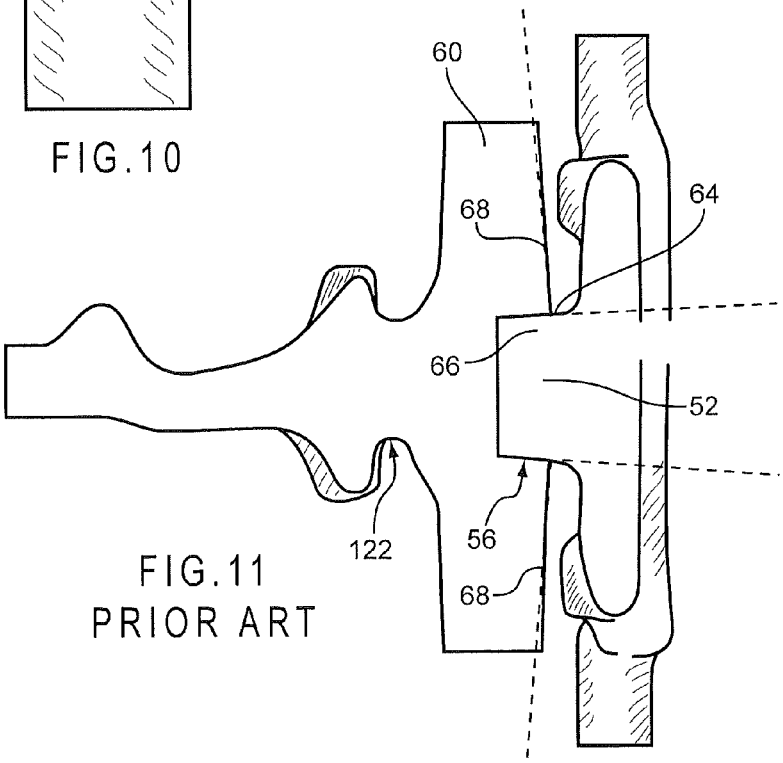
FIG.11 PRIOR ART
FIG. 11 shows a cross-sectional view of a prior art C-1 O/kidney core seated together with a prior art finger core.
Figure 12:
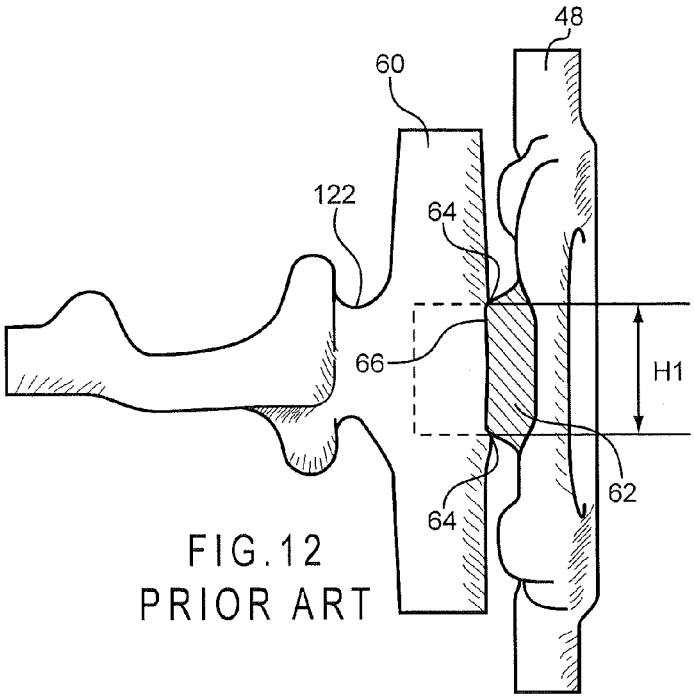
FIG.12 PRIOR ART
FIG. 12 shows the cores of FIG. 11 with the first transition section highlighted.
Figure 13:
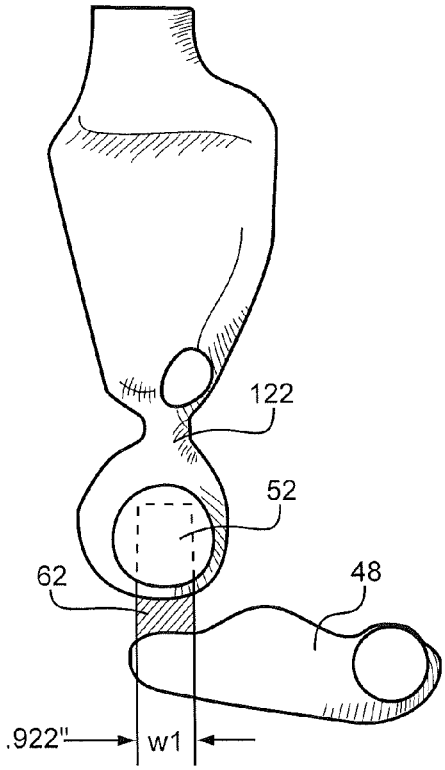
FIG. 13 shows a top view of the cores of FIG. 11 with the first transition section highlighted.

The section 62 has been altered from the prior art transition section 62 shown in FIGS. 11, 12 and 13 by increasing the thickness of this area both horizontally and vertically. For example, in the prior art, as shown in FIGS. 11 and 12, sharp corners 64 are formed at a first end 66 of the transition section 62 adjacent to the end wall 68 of the C-10 core 50 at the point where the lug 52 of the finger core 48 enters the slot 56 of the C-10 core 50. In the present invention, this sharp corner is eliminated and replaced with first radius 70 of about 0.10" from the first vertical wall 58 of the C-10 portion 60 of the core 50 to the end wall 68 of the C-10 portion of the core, which will be referred to as the first positive stop surface 74 and will be further described below. The first radius 70 is shown as R1 in the figures. A second radius 80 is formed on the finger core 48 and extends from the vertical wall of the second positive stop 76 on the finger core 48 and the outboard vertical portion 78 of the finger core 48. The second radius 80 preferably measures about 0.10" or greater and is labeled as R2 in the Figures. The first radius 70 can also be described as measuring about 0.10" between the first vertical wall 58 of the C-10 portion 60 of the core 50 to its tangent point with the second radius. The second radii can also be described as measuring about 0.10" between the outboard vertical portion 78 of the finger core 48 and its tangent point with the C-10 portion of the core 50.

Figure 7:
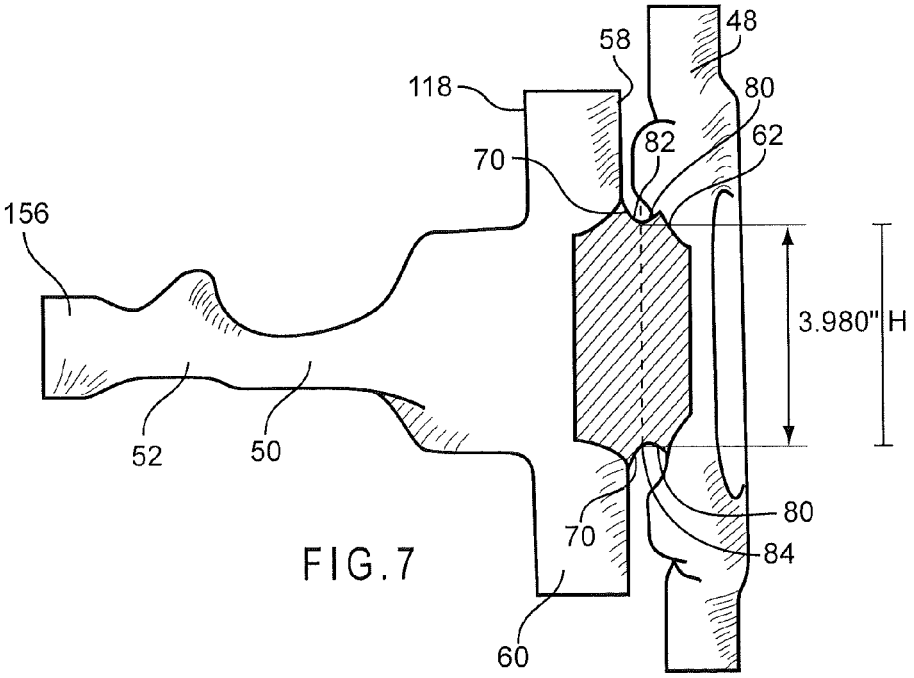
FIG. 7 shows the cores of FIG. 4 with the first transition section highlighted.
Figure 8:
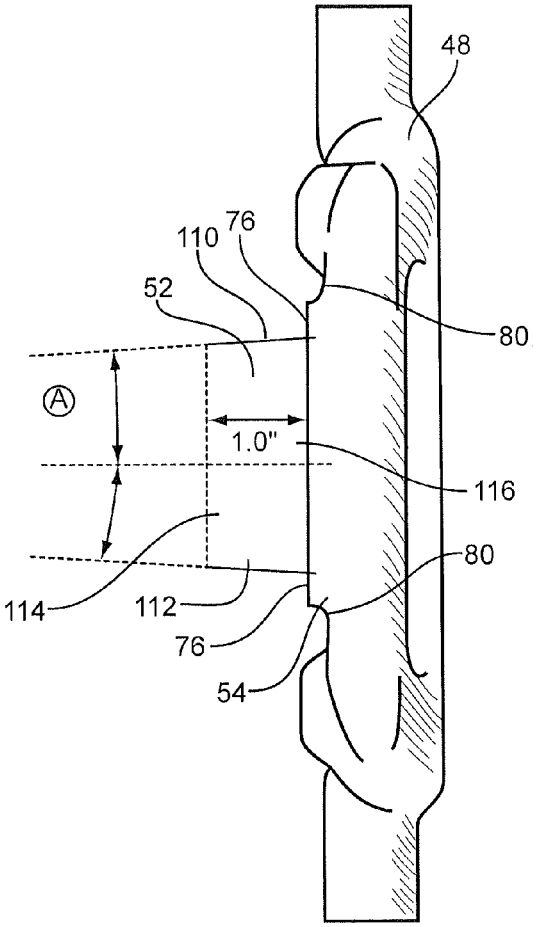
FIG. 8 shows a side view of the finger core of FIG. 4.
Figure 9:
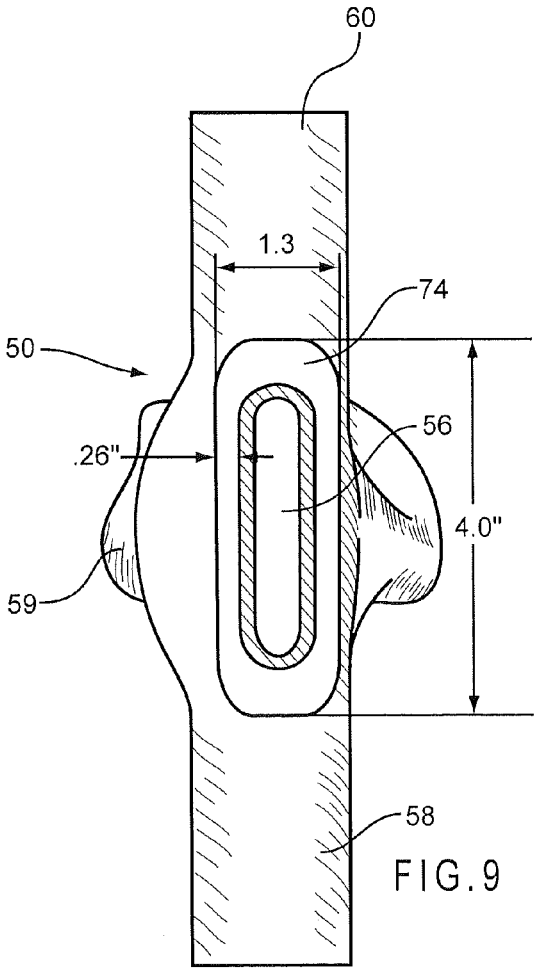
FIG. 9 shows a side view of the C-10 side of the C-1 O/kidney core of FIG. 4.
Figure 10:
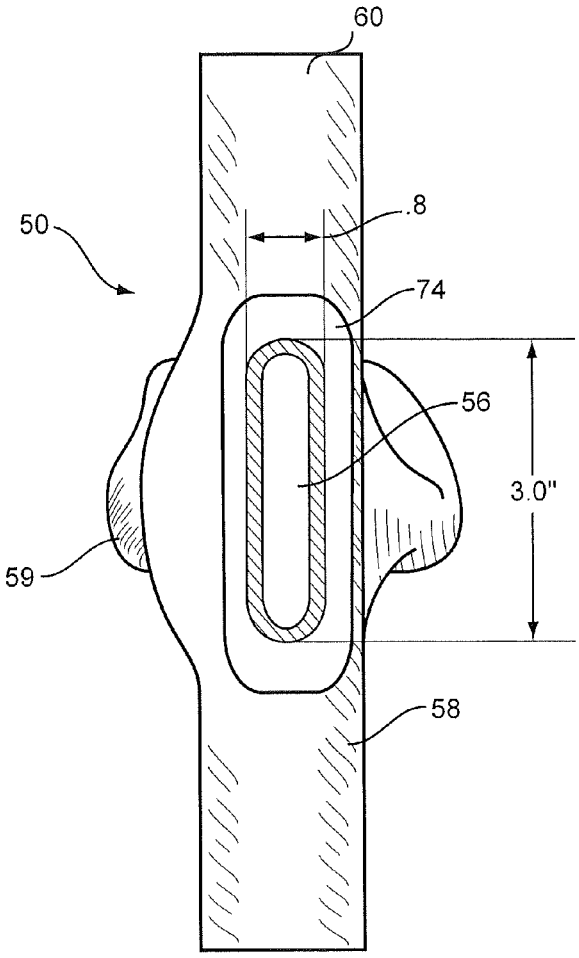
FIG. 10 shows a side view of the C-10 side of the C-10 kidney core of FIG. 4.
Figure 14:
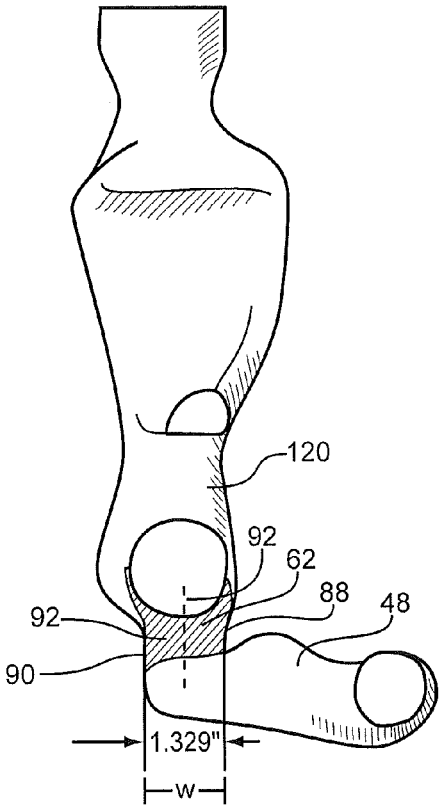
FIG. 14 shows a top view of the cores of 4 with the transition section highlighted.

The first transition section 62 between the C-10 portion 60 of the core and the finger core 48 has also been improved by increasing both the width W and the height H of the transition section 62 as shown in FIGS. 7 and 14 over the prior art (shown in FIGS. 12 and 13). The transition section 62 has first 82 and second 84 sides forming the vertical axis 86 (FIG. 7) and third 88 and fourth 90 sides forming the horizontal axis 92 (FIG. 14). The height H is formed from the point where the radii R1 and R2 meet on the top side 94 of the transition section 62 and the point where R1 and R2 meet on the bottom side 96 of the transition section 62. The width W of the transition section 62 is formed between the third 88 and fourth 90 sides of the transition section 62 as shown in FIG. 14. The third side 88 forms the inboard or throat side 98 of the knuckle 10 and the fourth side 90 forms the tail stop side 100 of the knuckle 10. The corresponding height H1 of about 2.40" and width W1 of about 0.922" of the prior art are shown in FIGS. 12 and 13.

The height H of this transition section 62 is preferably greater than about 2.5" and the width W is preferably greater than about 0.925". Alternatively, the height H can be increased at least about 75% over the corresponding prior art height and the width W can be increased at least about 50% over the corresponding prior art width. In a preferred embodiment, the height His about 3.98" and the width W is about 1.33".

Figure 15:
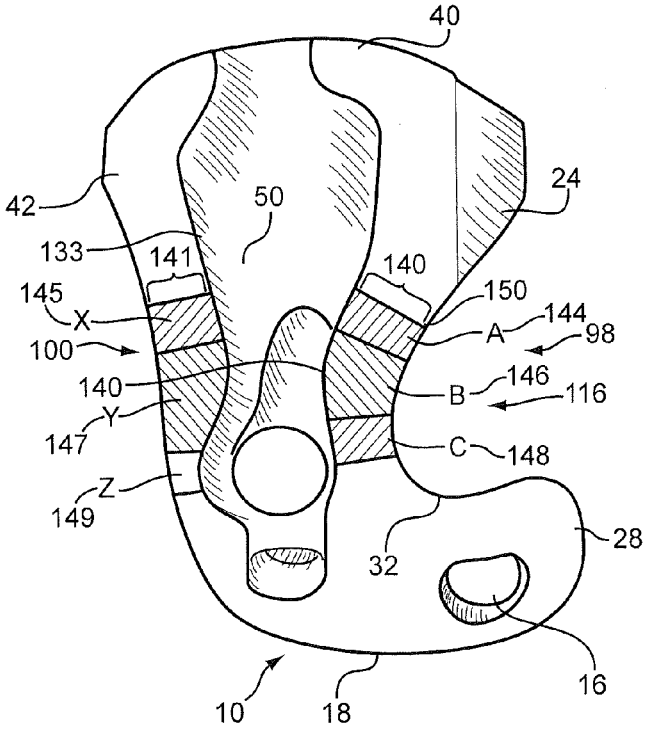
FIG. 15 shows the core of FIG. 4 in place in a knuckle pattern to show the shape of the knuckle that will form around the core.

These changes result in a smoother transition from the C-10/kidney core 50 to the finger core 48 than the prior art transition. The sharp angles 64 of the prior art are removed, and this smoother transition section 62 forms a more uniform wall 102 thickness in the corresponding area 104 of the finished knuckle 10 as shown in FIG. 15. The opening in the knuckle 10 in the area formed by the transition section 62 preferably about 3.0" high and about 0.8" wide.

Figure 5:
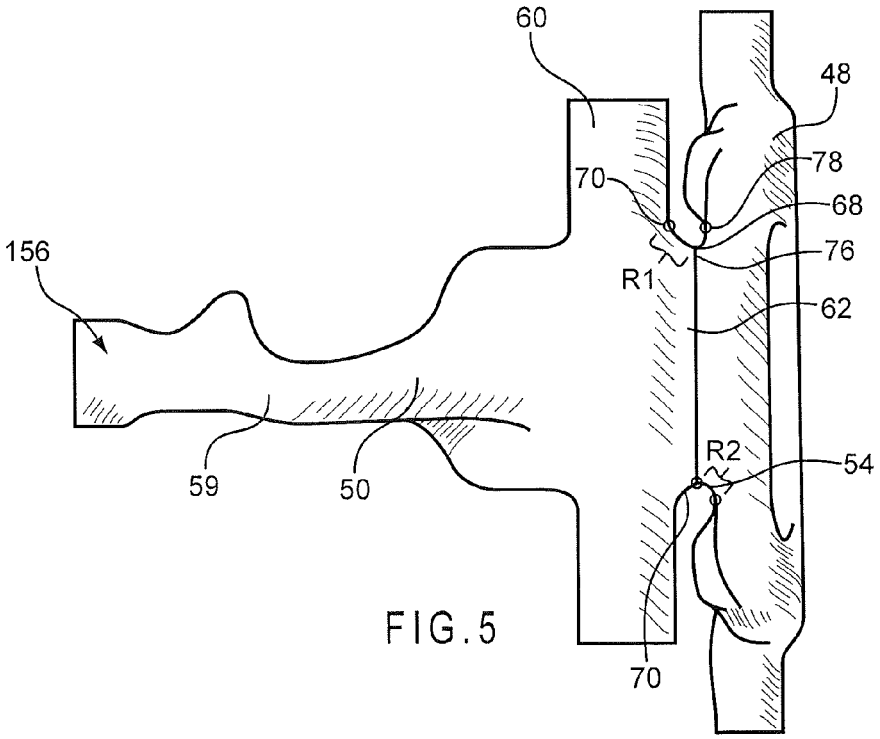
FIG. 5 shows the cores of FIG. 4 completely seated together.
Figure 6:
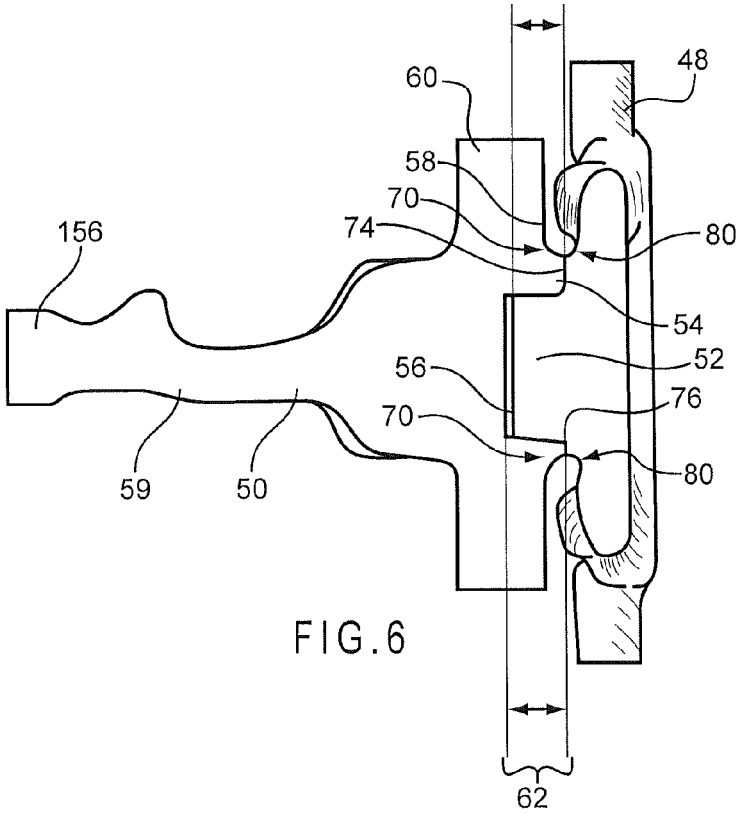
FIG. 6 shows a cross-sectional view of the cores of FIG. 4.

An additional aspect of the design of the first transition section 62 of the present invention is the addition of a positive stop. The positive stop is formed from corresponding vertical walls 74, 76 on the C-10 portion 60 of the C-10/kidney core 50 and the finger core 48, respectively. As shown in FIGS. 5-7, the positive stop construction allows the finger core 48 and the C-1 O/kidney core 50 to seat completely against each other in an exact fit, further reducing shifting of cores. Moreover, the design of the positive stop surfaces 74, 76 creates a 360° radius that extends around the entire connection joint 108. This results in reduced stresses and enhanced solidification in the finished knuckle 10 and reduced likelihood of hot tears. This positive stop construction also helps form the large radii R 1 and R2 as previously described. The larger radii help lower the stresses in the knuckle 10 as well, and provide a smoother, less turbulent flow of metal as the mold is filled. This in turn reduces the likelihood of hot tears.

A preferred construction of the first positive stop surface 74 of the C-10/kidney core 50 is shown in FIGS. 4, 6 and 8-10. A slot 56 is defined in the first wall 58 of the C-10 portion 60 of the C-10/kidney core 50 and may preferably be between about 0.6-1.0" wide and between about 2.00-3.5" high. The slot is 56 is preferably slightly larger than 1.0" deep to accommodate the lug 52. However, it can be between 0.5-2.5" deep depending on the size of the corresponding lug 56. The first positive stop surface 74 is defined on the first wall 58 of the C-10/kidney core 50 and extends 360° around the slot 56, preferably measuring about 0.10-0.35" outside of the slot 56 and being substantially parallel to the first wall 58.

Figure 4:
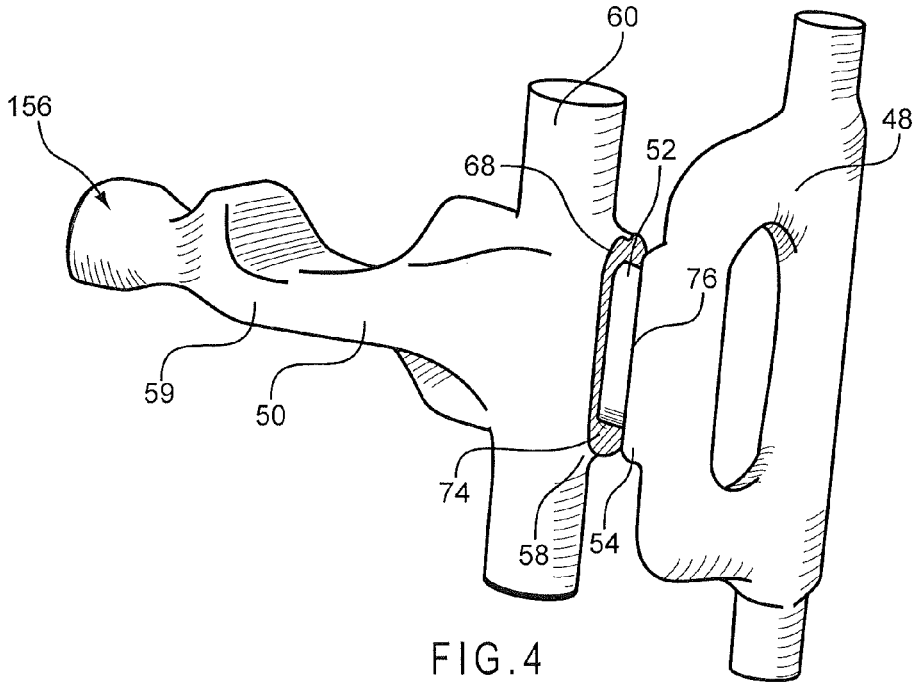
FIG. 4 shows a perspective view of a finger core of the present invention partially inserted into a kidney/C-10 core of the present invention.

The corresponding second positive stop surface 76 having substantially equal measurements as the first positive stop surface 74 in order to maintain a substantially exact fit is defined extending 360° around the lug 52 extending from the wall 54 of the finger core 48 and being substantially parallel to the wall 54 of the finger core 48. The second positive stop 76 preferably extends between about 0.10-0.35" outside of the surface of the lug 52. The lug 52 includes top 110 and bottom 112 walls that taper such that the height at the end 114 of the lug 52 that enters the slot 56 is less than the height of the opposite end 116 of the lug 52. The lug 52 is preferably greater than about 1.0" from the wall 54 of the finger core 48 to the end 114 of the lug 52. The lug 52 is preferably between about 0.60-0.90" wide and between about 2.75-3.25" high. The taper angle A is preferably greater than about 1°. FIG. 4 shows the finger core 48 being inserted into the C-10/kidney core 50 and FIG. 5 shows the two cores 48, 50 completely seated together with the first 72 and second 74 positive stops seated flush together and illustrates the smooth and substantially continuous transition section 62 between the two cores 48, 50. When the cores 48, 50 are seated together, this interlock feature 62 effectively forms a transition section 62 having a height of greater than about 2.5" and a width of greater than about 0.75".

The larger size transition section forms a much more robust joint which reduces the chance of joint breakage during handling of the cores before assembly or while they are being placed as an assembly into the mold.

In an alternative embodiment (not shown), the kidney and C-10 cores are separate. The lug and the first positive stop surface are defined on the C-10 core on a second wall 118. In this embodiment, the slot and the second positive stop surface are defined on the kidney core. The lug and slot and their respective stop surfaces are designed to fit together in the same way as the lug and slot from the previous embodiment.

In yet another alternative embodiment (not shown), a tab is defined on the slot and a corresponding hole is defined on the lug (or vice versa) to act as a failsafe so that the cores cannot be assembled backwards.

Figure 20:
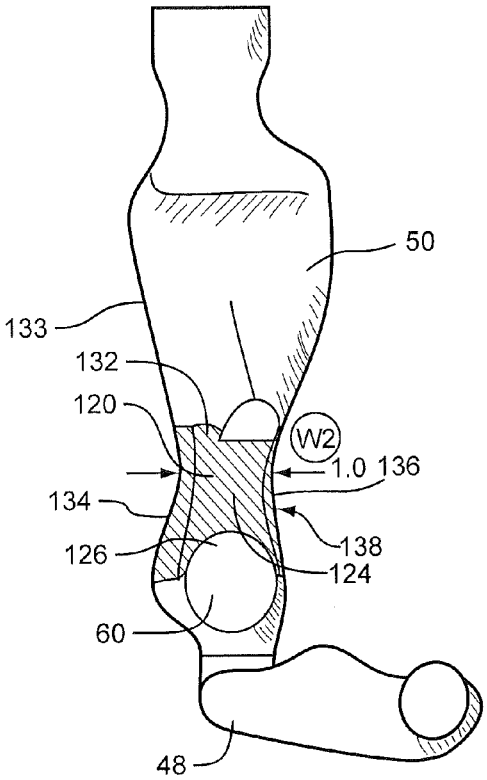
FIG. 20 shows a top view of the combined cores of FIG. 4.

Another aspect of the present invention is the modification of a second transition 120 section (shown generally as the shaded portion in FIGS. 17 and 20) between the kidney 59 and C-10 60 portions of the C-10/kidney core 50. As shown in FIGS. 11-13, prior art cores include an abrupt transition 122 at this point between these core sections 59, 60. This type of transition does not promote good metal flow throughout the knuckle during casting and can promote hot tears as the casting cools.

When feeding the casting from the front face 18, the liquid metal tends to cool quicker in thinner sections. In prior designs, the wall thickness in this area varies quite a bit, especially in the abrupt transition section 122 shown in FIG. 16. Since the liquid metal has to pass through a thinner section first before coming to the thicker wall created by the abrupt transition 122, it would cool more quickly which could cause defects in the final part.

Figure 16:
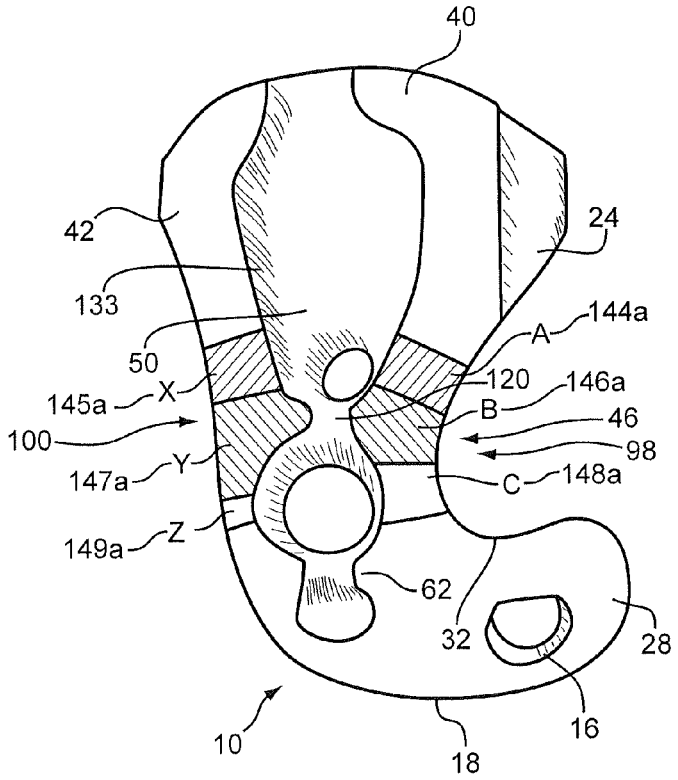
FIG.16 PRIOR ART
FIG. 16 shows the core of FIG. 11 in place in a knuckle cavity to show the shape of the knuckle that will form around the core.
Figure 17:
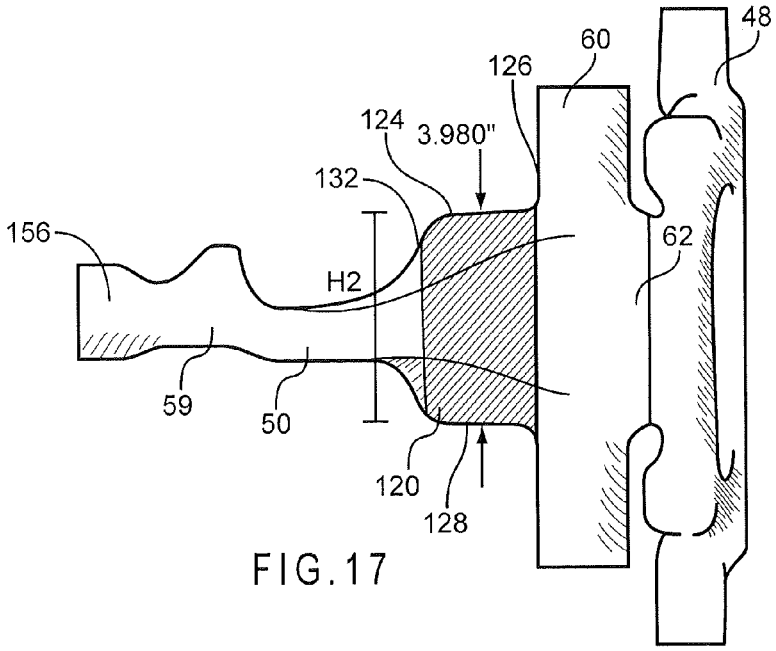
FIG. 17 shows a side view of the combined cores of FIG. 4.
Figure 18:
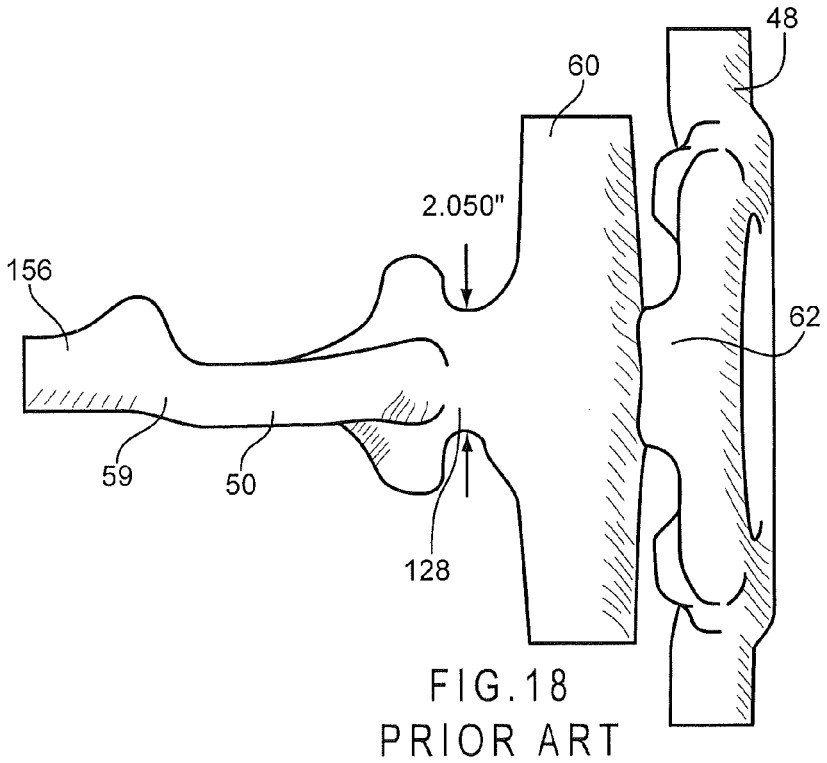
FIG.18 PRIOR ART
FIG. 18 shows a side view of the combined cores of FIG. 11.
Figure 19:
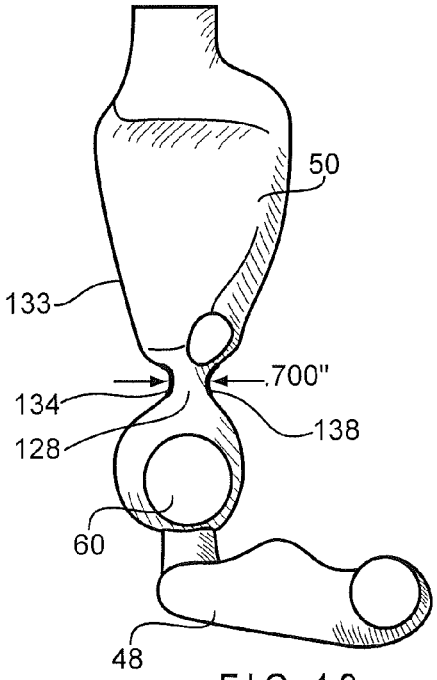
FIG.19 PRIOR ART
FIG. 19 shows a top view of the combined cores of FIG. 11.

In the present invention, as shown in FIGS. 4-7, 14, 15, 17 and 20, material has been added to the second transition section 120 as compared to the same area in prior art cores such as the one shown in FIGS. 11-13, 16, 18 and 19. As shown in FIG. 17, the second transition section 120 is defined by the top wall 124 extending between the kidney side wall 126 of the upper C-10 core portion 60 and the knuckle tail side 132. The bottom wall 128 extends between the lower wall of the C-10 core and the knuckle tail side 132; the first side 134 and the second side 136 extend between the throat side 138 of the knuckle 10 and the tail side 132 of the knuckle 10 respectively. At least about 1.93" of material has been added to the vertical height H2 of this section making it at least about 3.50" high and at least about 0.97" of material has been added to the horizontal width W2 of this section making it at least about 1" wide. This smoother transition results in more uniform wall throat side wall 140 thickness as shown in FIG. 15.

This smoother transition and more uniform throat side wall 140 is located in the throat portion 142 of the knuckle 10 and has a first section A 144 closest to the knuckle tail 40, a third section C 148 closest to the knuckle pulling face 32, and a second section B 146 between the first 144 and third 148 sections (FIG. 16 shows the same areas of typical prior art part using 144*a*, 146*a* and 148*a* respectively). It is important to note that the length of each section has been generalized in the figures for reference purposes, and the claims are not meant to be limited by the exact dimensions of these sections as shown.

In one embodiment the throat side wall 140 thickness of the first section 144 is preferably greater than the throat side wall 140 thickness of the second section 146 and the throat side wall 140 thickness of the second section 146 is preferably greater than the throat side wall 140 thickness of the third section 148. Furthermore, the difference in thickness of at least part of the throat side wall 140 in the first section 144 and at least part of the throat side wall 140 in the third section 148 is less than about 17%, the difference in thickness between at least part of the throat side wall 140 in the first section 144 and at least part of the throat side wall 140 in the second section 146 is less than about 11%, and the difference between the thickness of at least part of the throat side wall 140 in the second section 146 and at least part of the throat side wall 140 in the third section 148 is less than about 11%. In another embodiment, the difference in thickness between at least part of the throat side wall 140 in the first section 144 and at least part of the throat side wall 140 in the second section 146 is less than about 17%, and the difference between the thickness of at least part of the throat side wall 140 in the second section 146 and at least part of the throat side wall 140 in the third section 148 is less than about 30%. In yet another embodiment, the difference in thickness between at least part of the throat side wall 140 in the first section 144 and at least part of the throat side wall 140 in the second section 146 is less than about 4%, and the difference between the thickness of at least part of the throat side wall 140 in the second section 146 and at least part of the throat side wall 140 in the third section 148 is less than about 11%.

As an example, the thickness of at least part of the throat side wall 140 within section A 144 can be at least about 1.39", the thickness of at least part of the throat side wall 140 within section B can be at least about 1.34" and the thickness of at least part of the throat side wall 140 within section C can be at least about 1.19". As a reference, in the prior art knuckle shown in FIG. 16, the thickness of at least part of the throat side wall 140 within section A 144 can be at least about 1.40", the thickness of at least part of the throat side wall 140 within section B can be at least about 1.69" and the thickness of at least part of the throat side wall 140 within section C can be at least about 1.19".

In an additional embodiment the throat side wall 140 thickness of the first section 144 is preferably less than the throat side wall 140 thickness of the second section 146 and the throat side wall 140 thickness of the second section 146 is preferably less than the throat side wall 140 thickness of the third section 148. In this embodiment, the thickness of the wall in the entire throat side wall 142 of the throat section comprising sections A, B and C varies by less than 10% throughout the throat section. In yet another embodiment, the entire throat side wall 140 comprising sections A, B and C varies by less than 17% throughout the tail stop side wall 141. In yet another embodiment, the entire throat side wall 140 comprising sections A, B and C varies by less than 3.5% throughout the tail stop side wall 141.

A similar change has been applied to the tail stop side 133 of the core. Material has been added to the vertical height H2 and the horizontal width W2 of this section. This smoother transition results in more uniform tail stop side wall 141 thickness as shown in FIG. 15. This smoother transition is located in the tail stop side wall 141 of the throat portion of the knuckle 10 and has a first section X 145 closest to the knuckle tail 40, a third section Z 149 closest to the knuckle pulling face 32, and a second section Y 147 between the first 145 and third 149 sections (FIG. 16 shows the same areas of typical prior art part using 145*a*, 147*a* and 149*a* respectively). It is important to note that the length of each section has been generalized in the figures for reference purposes, and the claims are not meant to be limited by the exact dimensions of these sections as shown.

In one embodiment, the tail stop side wall 141 thickness of at least part of the first section 145 is preferably greater than the tail stop side wall 141 thickness of the second section 147 and the tail stop side wall 141 thickness of the second section 147 is preferably greater than the tail stop side wall 141 thickness of the third section 149. Furthermore, the difference in thickness between at least part of the tail stop side wall 141 in the first section 145 and at least part of the tail stop side wall 141 in the second section 147 is less than about 32%, and the difference between the thickness of at least part of the tail stop side wall 141 in the second section 147 and at least part of the tail stop side wall 141 in the third section 149 is less than about 68%. In another embodiment, the difference in thickness between at least part of the tail stop side wall 141 in the first section 145 and at least part of the tail stop side wall 141 in the second section 147 is less than about 4%, and the difference between the thickness of at least part of the tail stop side wall 141 in the second section 147 and at least part of the tail stop side wall 141 in the third section 149 is less than about 51%.

As an example, the thickness of at least part of the tail stop side wall 141 within section X 144 can be at least about 1.23", the thickness of at least part of the tail stop side wall 141 within section Y can be at least about 1.19" and the thickness of at least part of the tail stop side wall 141 within section Z can be at least about 0.58". As a reference, in the prior art knuckle shown in FIG. 16, the thickness of at least part of the tail stop side wall 141 within section X 144 can be at least about 1.23", the thickness of at least part of the tail stop side wall 141 within section Y can be at least about 1.81" and the thickness of at least part of the tail stop side wall 141 within section Z can be at least about 0.58".

In yet another embodiment, the entire tail stop side wall 141 comprising sections X, Y and Z varies by less than 32% throughout the tail stop side wall 141. In yet another embodiment, the entire tail stop side wall 141 comprising sections X, Y and Z varies by less than 3.2% throughout the tail stop side wall 141.

Furthermore, in another embodiment the tail stop side wall 141 thickness of the first section 145 is preferably less than the tail stop side wall 141 thickness of the second section 147 and the tail stop side wall 141 thickness of the second section 147 is preferably less than the tail stop side wall 141 thickness of the third section 149. Again, in this alternative embodiment, it is preferred that the tail stop side wall 141 thickness throughout the entire throat section comprising sections, X, Y, and Z varies by less than 17%. In a further alternative embodiment, it is preferred that the tail stop side wall 141 thickness throughout the entire throat section comprising sections, X, Y, and Z varies by less than 3.5%. These changes result in a slightly thicker cross sectional area in one of the highest stress areas in the casting. The thicker area lowers the stress.

Figure 21:
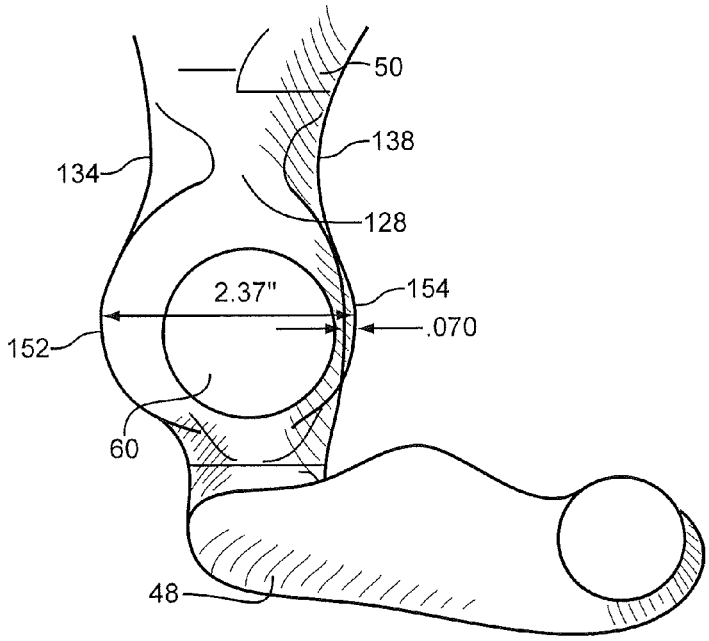
FIG. 21 shows a top view of a comparison of the cores of FIGS. 4 and 11 at the second transition section between the kidney/C-10 core and the finger core.
Figure 39:
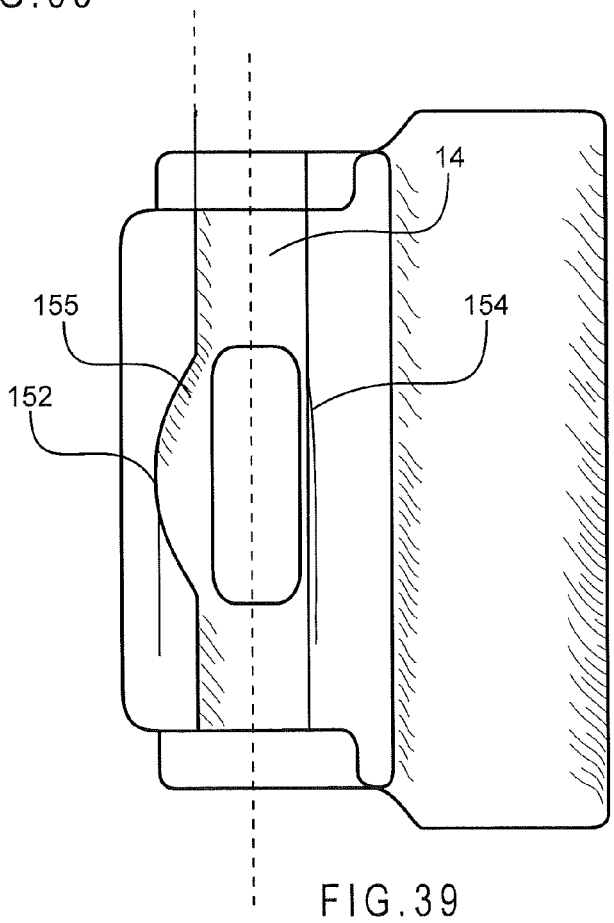
FIG. 39 is a cross sectional view of a knuckle of the present invention showing the C-10 pin hole.

This newly designed second transition section 120 results in a knuckle 10 having walls 150 that are approximately 1.0" thick or greater, as shown in FIG. 15. Additionally, an embodiment of the present invention has about 0.070" of material less than a prior art core on the throat side 138 of the C-10 core 60 as shown in FIG. 21 which shows a prior art core superimposed on an embodiment of the present core. This results in a core that measures about 2.370" from the tail stop side wall 152 to the throat side wall 154 as shown in FIG. 21. This change results in a centrally located relief area 155 in the C-10 pinhole 14 of the resulting knuckle 10 that is greater than 108% of the pivot pinhole diameter, as shown in FIG. 39.

In an alternative embodiment of the invention, three cores are used as in the prior art, but with the structural changes to the transition sections as detailed above. Furthermore, with respect to utilizing separate C-10 and kidney cores, it is envisioned that a lug and slot connection mechanism with positive stops on the vertical walls of each core can be used in the same fashion as the lug and slot connection with positive stops between the C-10/kidney and finger cores, as previously described. This would form a transition section having positive stops, a lug and a slot in the area between the kidney and C-10 cores. The lug would preferably extend from the C-10 core into a corresponding slot on the kidney core.

Figure 26:
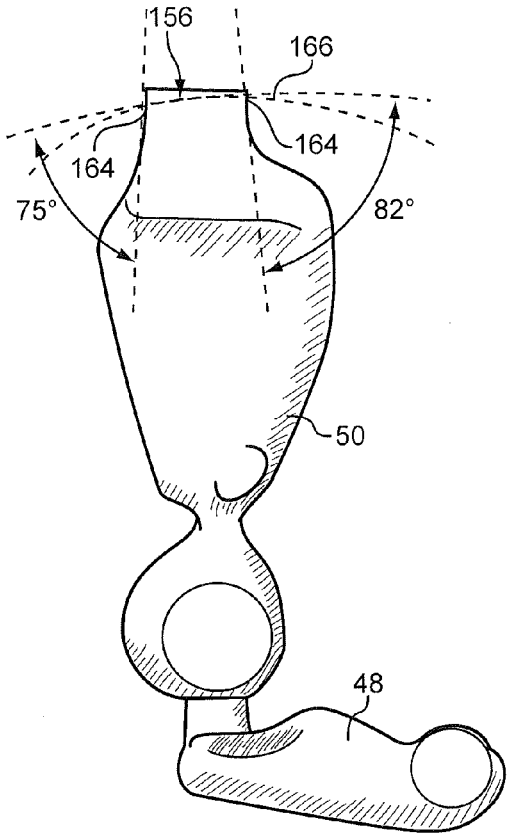
FIG.26 PRIOR ART
FIG. 26 shows a top view of the combined core of FIG. 11 with angles added.
Figure 27:
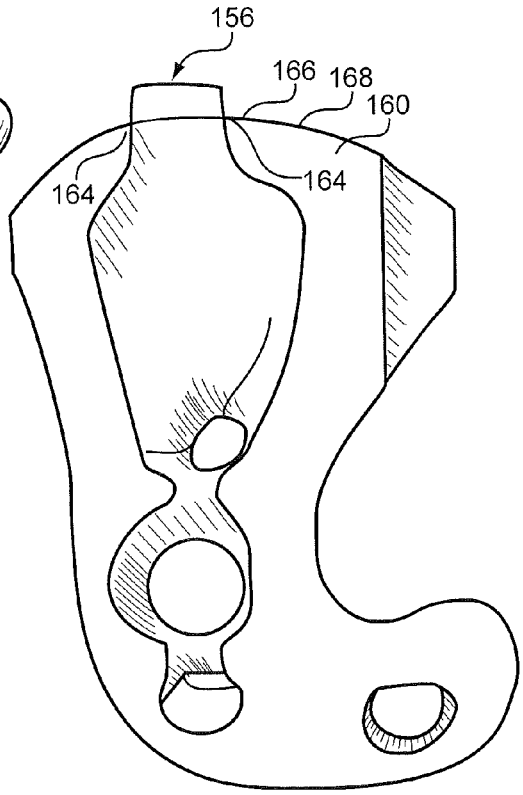
FIG.27 PRIOR ART
FIG. 27 shows a top view of the core of FIG. 11 in place in a knuckle cavity to show the extension of the rear core support outside the cavity.

In another aspect of the present invention, the rear core support 156 of the kidney section 59 of the C-10/kidney core 50 has been redesigned in order to improve core support and reduce shifting. During casting, the cores that form the interior spaces of the part are seated in the core prints of a mold 160 comprising cope and drag sections with the cores 48, 50 positioned in the drag. The redesigned rear core support section 156 also eliminates a sharp corner 162 that is typically formed in prior art cores due to an acute angle 164 at the plane 166 where the rear core support 156 exits the cope and drag. An exemplary prior art design is shown in FIGS. 26 and 27.

Figure 22:
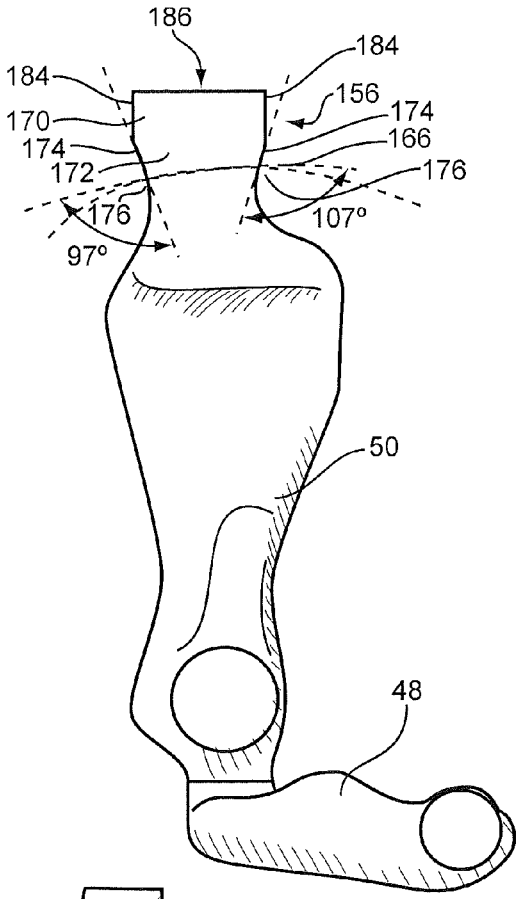
FIG. 22 shows a top view of the cores of FIG. 4 with exemplary measurements added to the rear core support.
Figure 23:
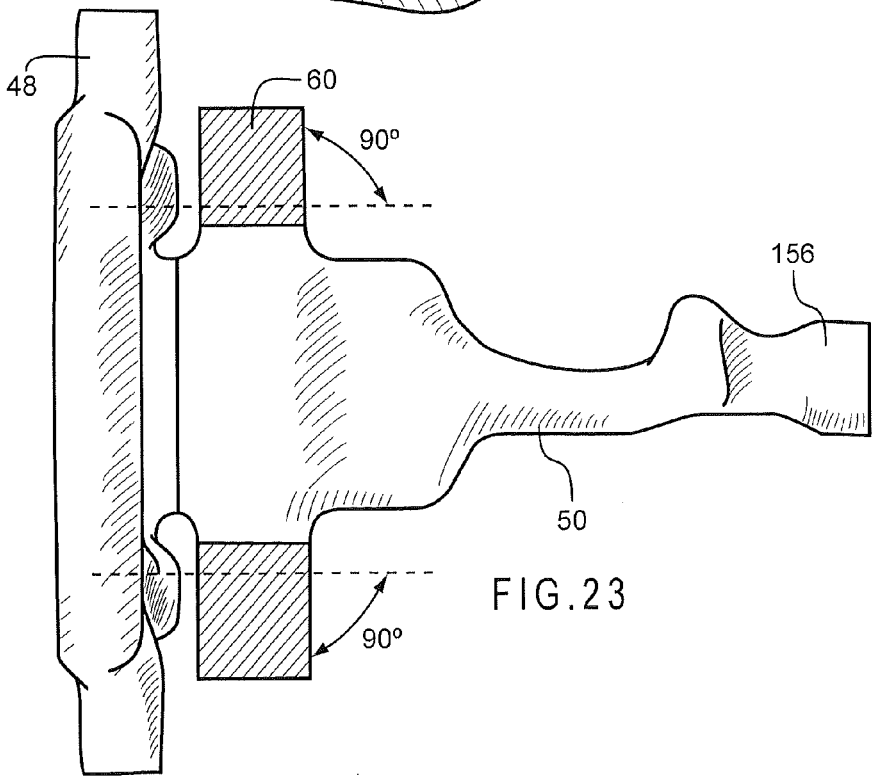
FIG. 23 shows a side view of the combined cores of FIG. 4.
Figure 24:
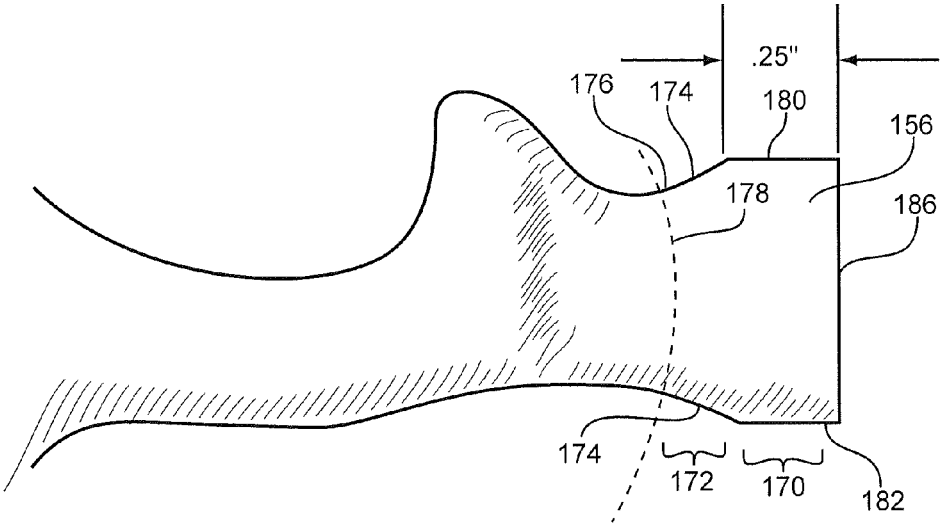
FIG. 24 a close up side view of the rear core support of FIG. 4.
Figure 25:
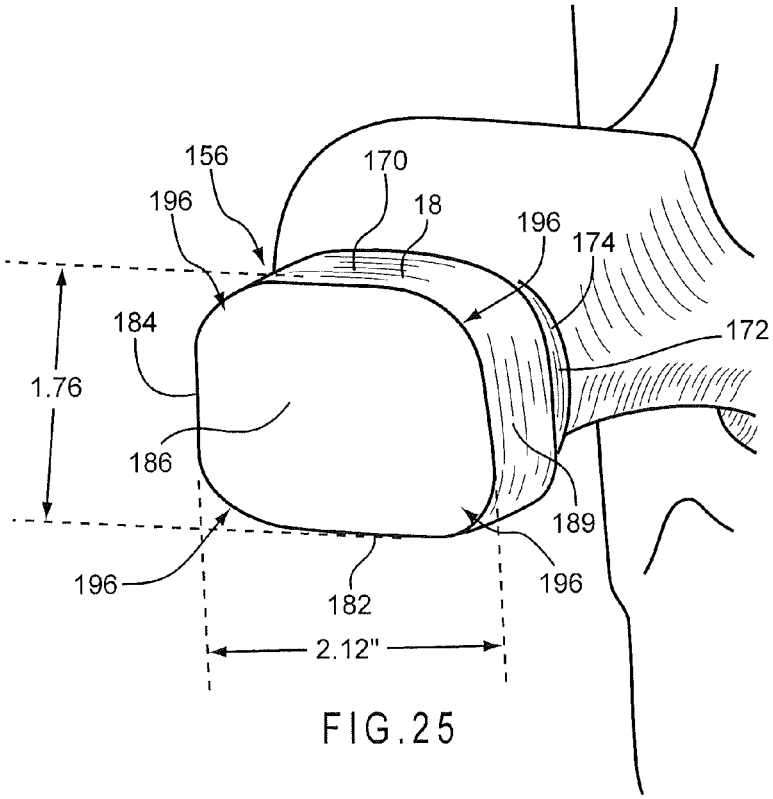
FIG. 25 shows a close up perspective view of the rear core support of FIG. 4.
Figure 28:
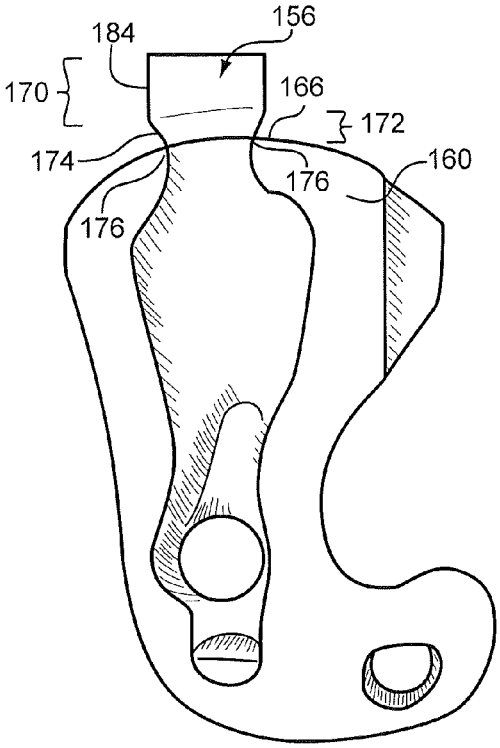
FIG. 28 shows a top view of the core of FIG. 4 in place in a knuckle cavity to show the extension of the rear core support outside the cavity.

The term "cavity" as used below refers to the portion of the cope and drag that forms the outside walls 168 of the knuckle 10. FIG. 28 shows the shape of the cavity in the drag with the combined cores 48, 50 in position. The rear core support section 156 includes a straight section 170 and a flared section 172 and preferably extends at least 0.5" outside the plane 166 of the cavity that forms the vertical outside wall 168 of the tail 40 of the knuckle 10 when the cores 48, 50 are in place in the drag. Furthermore, the walls 174 of the rear core support 156 that extend outside this plane 166 flare outwards such that obtuse angles 176 are formed between the walls 174 and both the vertical and horizontal exit planes 166, 178 of the rear core support 156 from the cavity as shown in FIGS. 22 and 24. These outwardly flared walls 174 increase the stability of the cores 48, 50, aid the solidification of the metal in these areas of the knuckle 10, and reduce stress concentrations around the edge of the hole 188 in the knuckle tail 40 and reduce the likelihood of hot tears. Stress risers are also reduced in these areas due to the elimination of the acute angles in the prior art.

In a preferred embodiment the rear core support 156 comprises a flared section 172 and a straight section 170. The top 180 and bottom 182 walls of the straight section 170 of the rear core support 156 are at least about 2.12" wide.

The side walls 184, 186 of the straight section 170 of the rear core support 156 are at least about 1.76" tall. The distance from the exit plane 166 to the end 186 of the core print is preferably at least about 0.25". The radii of the corners 196 of the straight section 170 of the rear core support 156 are preferably about 0.3-0.6". The width W3 of the rear core support 156 is preferably about 2.12" and the height is preferably about 1.76". Furthermore, it is important to note that these measurements can change to accommodate different core print sizes. The area of the rear core support 156 is between about 1.5-4.0 square inches. In an alternative embodiment, the rear core support section 156 includes a smaller radius on the bottom of said rear core support section 156 than on the top of said rear core support section 156.

Figure 29:
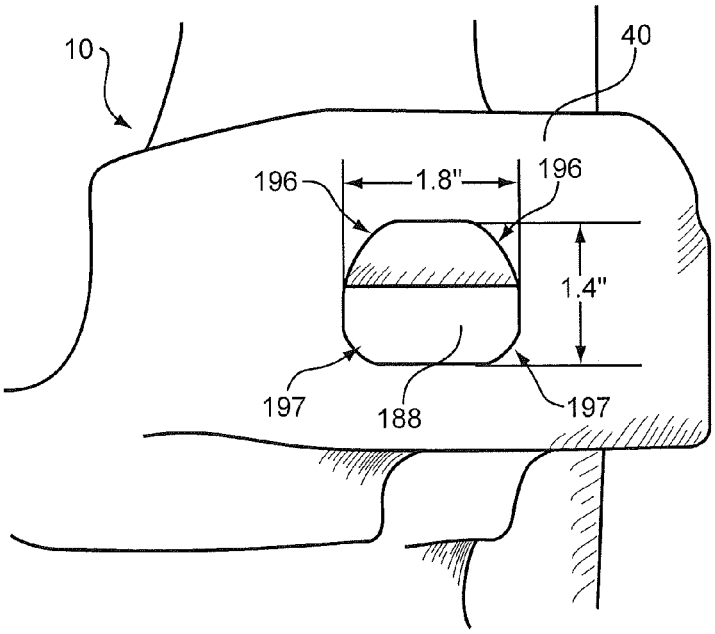
FIG. 29 is a rear view of a knuckle core formed with the cores of the present invention.
Figure 30:
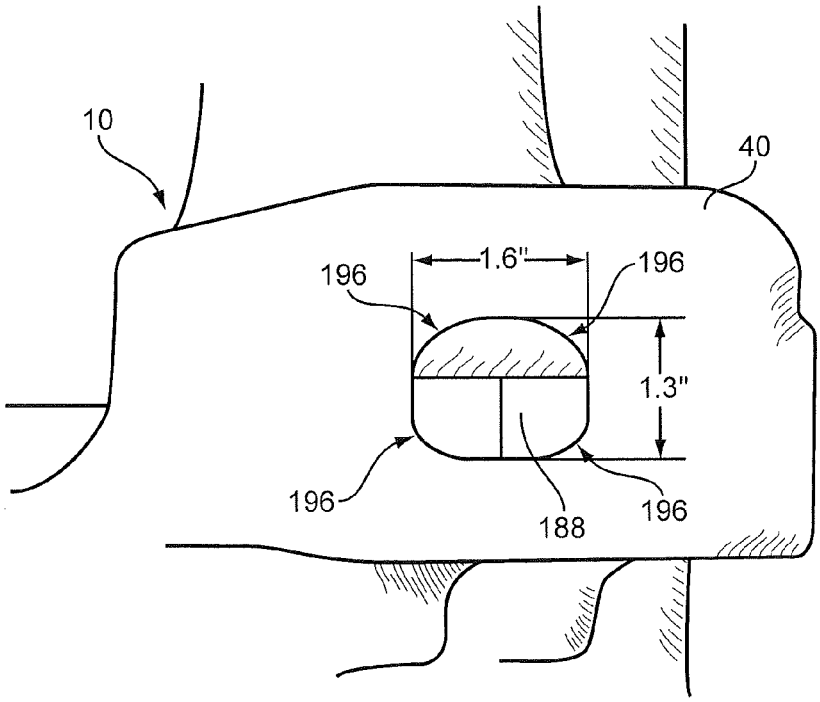
FIG.30 PRIOR ART
FIG. 30 is rear view of a prior art knuckle formed with prior art cores.

The use of this core combination 48, 50 results in a knuckle 10 as shown in FIG. 29 that has an opening 188 in the knuckle tail 40 having a ratio of height to width of between about 1:0.4 and 1:1.3, a ratio of height to the maximum corner radius of between about 1:1.25 and 1:18, and a ratio of the width to the maximum corner radius of between about 1:1.75 and 1:22. The opening 188 in the knuckle tail 40 is between about 1.4-2.2" wide and the height of the opening is between about 1.0-1.8". In an alternative embodiment, the corner radii 196, 197 are greater than about 0.25". In a further alternative embodiment, the opening has a corner radius of between about 0.1-0.8" In a further embodiment, the upper corner radii 196 are preferably at least 0.65" and the lower corner radii 197 are preferably at least 0.4".

Figure 31:
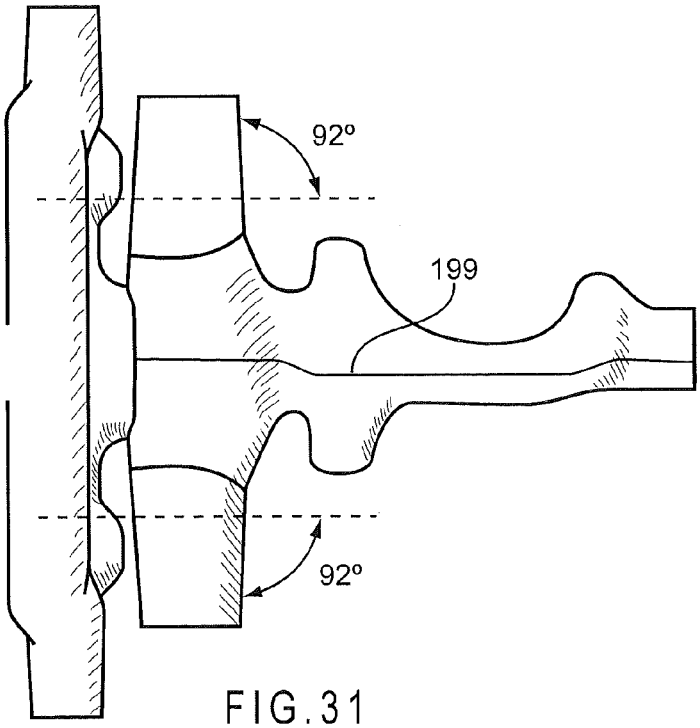
FIG.31 PRIOR ART
FIG. 31 shows a side view of the core of FIG. 11 with the horizontal parting line shown.

In a further embodiment of the present invention, a method of forming a core for a coupler knuckle is provided. Traditionally, cores are formed in a mold that results in a part having a horizontal parting line 199, as shown in FIG. 31. The cores are traditionally formed through a heated resin process or an Isocure process. The present invention utilizes a shell core process. As known in the art, a shell core process is a heat activated system that utilizes coated sand. The sand can be hot coated with a flaked phenolic novolak resin by mixing the resin with the sand and then heating it, melting the resin to coat the sand. The resin-coated sand is quenched with a water solution of hexamethylene tetramine and mulled until the sand mass breaks down. The sand is then aerated to particulate it. Alternatively, the sand can be warm coated. Calcium stearate, hexa-powder and water/alcohol solution of novolak resin is added to the sand and heated. This mixture is then cooled and aerated to particulate it. The coated sand from either of these processes is then placed in a heated corebox and allowed to dwell until the desired thickness of the shell of the fused sand in the heated core box is achieved. After curing, the shell is ejected from the box. Typically, in the more traditional processes which use an Isocure process, these coreboxes separate along the horizontal axis, forming a horizontal parting line and the walls are drafted accordingly.

Figure 32:
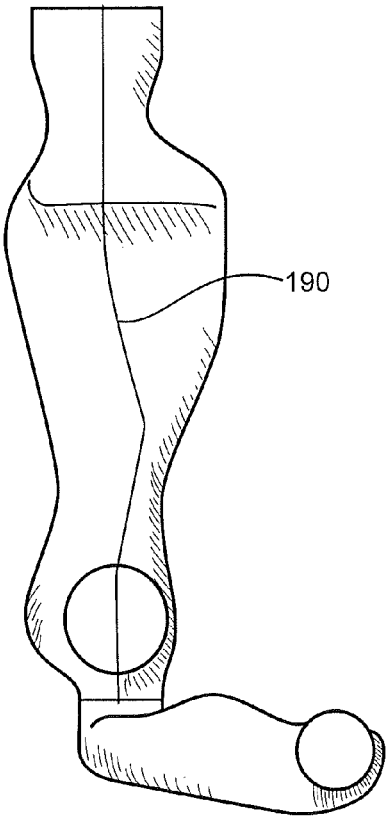
FIG. 32 shows top view of the core of FIG. 4 with the vertical parting line shown.
Figure 33:
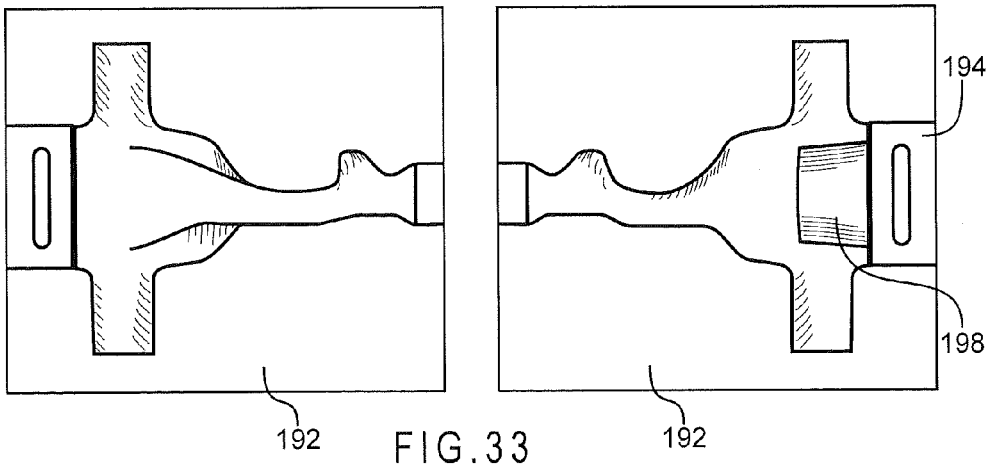
FIG. 33 is a top view of an open vertically parted core box with a loose piece in place.
Figure 34:
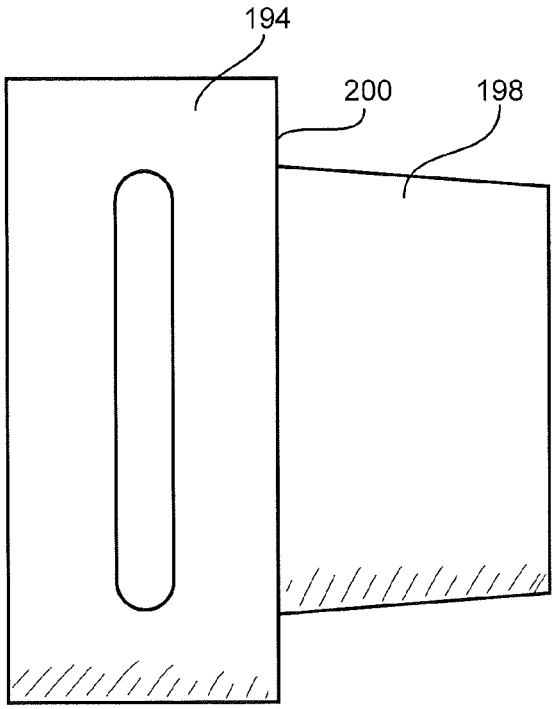
FIG. 34 is a side view of the loose piece of FIG. 33.
Figure 35:
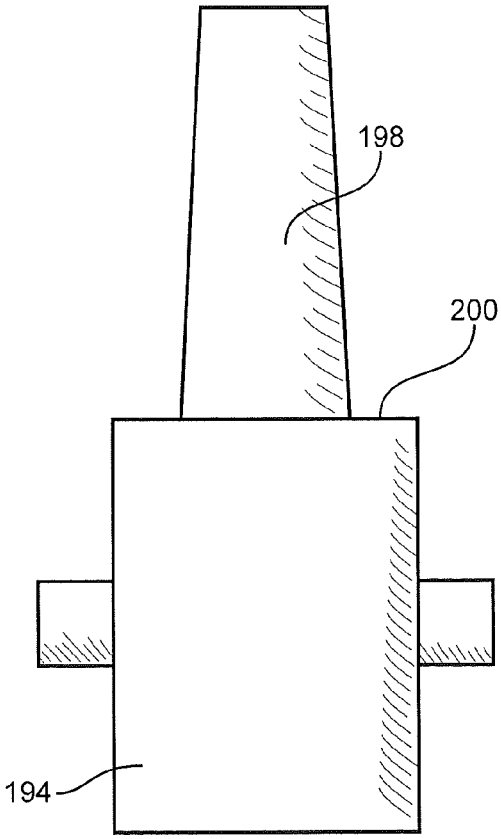
FIG. 35 is a top view of the loose piece of FIG. 33.
Figure 36:
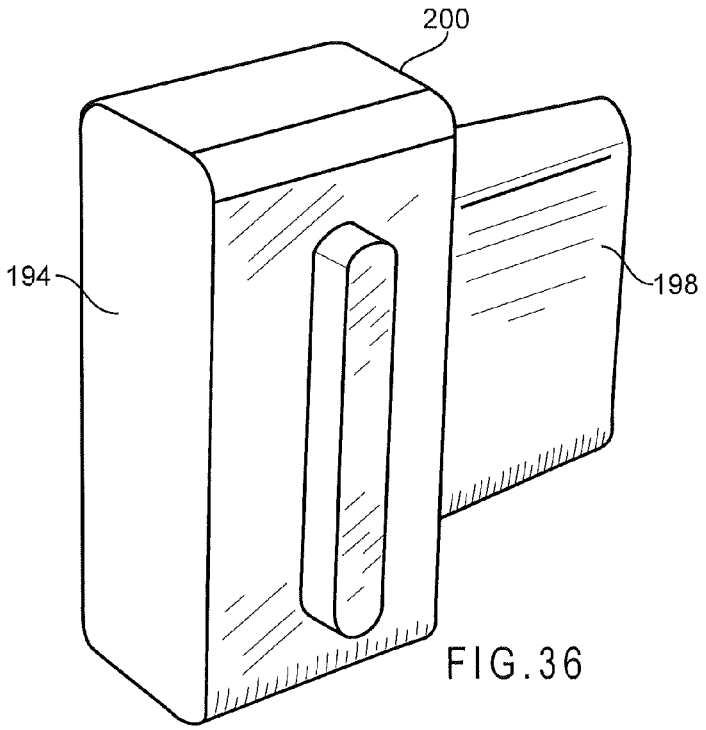
FIG. 36 is a perspective view of the loose piece of FIG. 33.

The method of the present invention can incorporate a vertically oriented parting line 190 positioned along the approximate middle of the core running from the rear core extension 198 to the end of the C-10 portion of the core 60. This parting line 190 is illustrated in FIG. 32 on the completed core. FIG. 33 shows the two halves of the corebox 192 in an open position. The first and second halves of the corebox 192 are prepared having the appropriate half of the features for the C-10/kidney core. The draft angles of the cores are also appropriately shifted to accommodate this change due to the reorientation of the parting line 190. The resulting draft angle of the C-10 portion 60 of the vertically parted core is preferably less than 3°, which results in a C-10 portion of the final knuckle with a draft angle of less than 3° as cast. A further embodiment has no draft.

Although loading of the C-10 pin in the current design is avoided, should some loading occur after wear of knuckle 10 loading surfaces has occurred, a uniformly loaded C-10 pin will result because of the zero draft C-10 pin hole 14. In comparison, the C-10 hole of a horizontally parted core typically has up to a 3° draft angle and results in point loading of the C-10 pin and knuckle C-10 pin hole 14. Point loading of the C-10 pin is more likely to result in bending of the pin or pin failure, either of which can make the coupler knuckle 10 difficult or impossible to operate properly. Point loading can also occur in the drafted C-10 knuckle pin hole 14, which can also lead to higher than expected loading conditions in the C-10 pin hole 14. The 90° shift of the parting line allows for extremely accurate dimensioning of the C-10 pin hole as compared to point loading of a drafted C-10 pin hole.

The above method may be used to form cores through a shell core process, an air set process, or any other core production process known in the art.

Furthermore, if the cores 48, 50 include an interlock feature such as that described above, a separate loose piece 194 can be used in the corebox 192 positioned in a recess on the outside of the C-10 portion of the corebox 192 on the side where the finger core 48 would include a corresponding lug 52. The loose piece 194 includes an extension 198 on at least one side that extends into the opening that forms the C-10 portion of the core. The extension 198 of the loose piece preferably measures at least about 3.0" high and at least about 0.8" wide. Furthermore, the loose piece 194 includes a flat face 200 adjacent the extension 198 that forms the first positive stop 74 on the C-10 portion of the core. This flat face measures at least about 4.0" high and at least about 1.3" wide and extends 360° around the extension 198.

Figure 37:
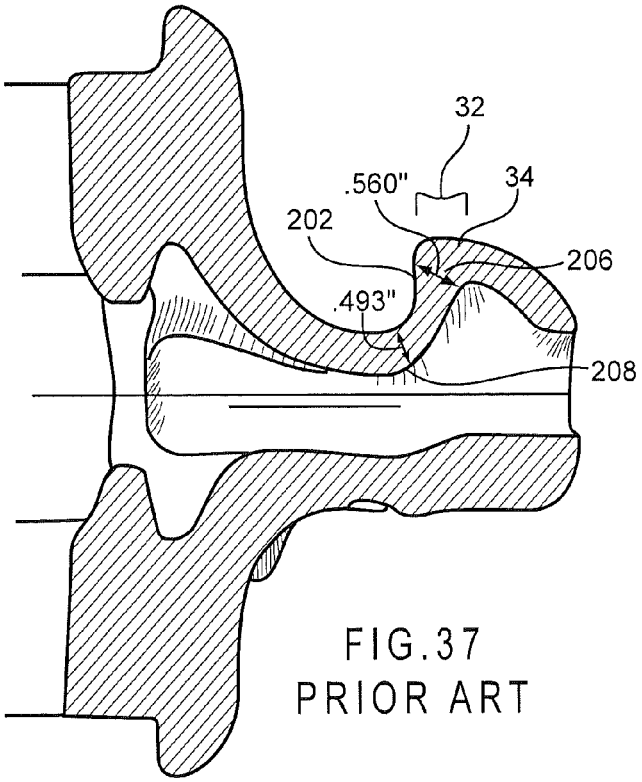
FIG.37 PRIOR ART
FIG. 37 is a side cross-sectional view of a prior art knuckle showing the opening formed by a prior art kidney core.
Figure 38:
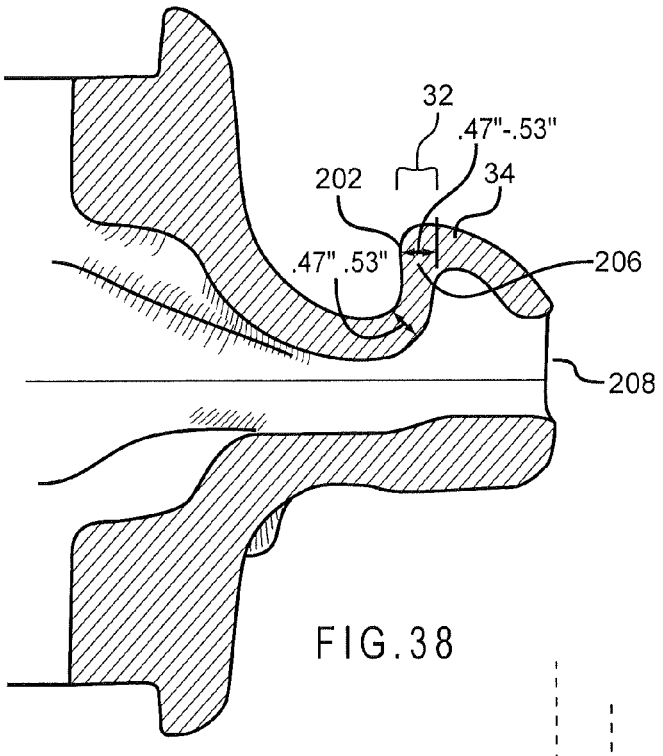
FIG. 38 is a side cross-sectional view of a knuckle formed with the core of FIG. 4.

The top knuckle pulling lug 34 was also redesigned to create a more unified wall thickness, as shown in FIG. 38 as compared to the same area of a prior art core shown in FIG. 37. This change results in a knuckle 10 with a pulling lug vertical wall 202 that has a uniform wall thickness on the front face 204 of the pulling lug 34. As shown in FIG. 37, the wall thickness of a traditional pulling lug face 32 varies from the top 206 of the pulling lug face 32 to the bottom 208 of the face 32. In the example shown, the wall face 32 goes from 0.560" at the top 206 of the pulling lug face to 0.49" at the bottom 208 of the pulling lug face 32. In the redesigned knuckle 10 of the present invention, the wall thickness remains substantially the same from the top 206 to the bottom 208, as shown in FIG. 38. In an exemplary embodiment, the wall thickness remains at about 0.47-0.53" from the top 206 of the pulling lug face 32 to the bottom 208 of the pulling lug face 32. Alternatively, this uniform wall thickness of the front face 32 of the pulling lug 34 may be formed through the use of appropriately redesigned horizontally parted cores.

Because the pulling lugs 34 transmit the major portion of the longitudinal load applied to the coupler, the uniform wall thickness, particularly at the bottom radius 210 of the top pulling lug 34, results in a stronger design. The uniform section wall thickness also permits more consistent metal filling and more consistent metal cooling, which should improve the solidity or soundness of the casting in this area and reduce the likelihood of hot tears. This is important because the AAR places a high standard on these areas of the knuckle. They are required to pass a static tension test of a minimum ultimate load of 650,000 lbs. This large load that must pass through these pulling lugs 34 can result in very high stress and deflections, not to mention the repeated loading of this feature creates extreme fatigue conditions requiring near perfect surface and subsurface material conditions.

It is intended that the foregoing detailed description be regarded as illustrative rather than limiting, and that it be understood that it is the following claims, including all equivalents, that are intended to define the spirit and scope of this invention.

The invention claimed is:

1. A railcar coupler knuckle comprising:
a C-10 pin hole; and
a top knuckle pulling lug,
wherein interior spaces of the railcar coupler knuckle are formed using a core comprising:
a rear core support configured to support the core when the core is assembled in a mold used to cast the railcar coupler knuckle;
a C-10 portion configured to form the C-10 pin hole in the railcar coupler knuckle; at least a part of the C-10 portion begin formed as a substantially curved portion having a curved cross-section;
a contoured surface configured to provide detail to the interior spaces of the railcar coupler knuckle; and
a parting line defined on the contoured surface along a vertical direction of the core, wherein the vertical direction is a direction extending from the rear core support to the C-10 portion, and; the parting line substantially bisects the curved cross-section of the part of the C-10 portion being formed as the substantially curved portion,
wherein the railcar coupler knuckle has a wall thickness that has a substantially constant thickness over a majority of the distance from the top of a front face of the top knuckle pulling lug to a bottom face of the top knuckle pulling lug.

2. The railcar coupler knuckle of claim 1, wherein the C-10 pin hole has a draft angle of less than 3 degrees, as cast.

3. The railcar coupler knuckle of claim 1, wherein the top knuckle pulling lug has a wall thickness of between about 0.47" and 0.53" throughout an entirety of the top knuckle pulling lug.

4. The railcar coupler knuckle of claim 1, wherein the core includes a kidney portion and wherein the kidney portion includes a first section that forms the top knuckle pulling lug of the railcar coupler knuckle.

5. The railcar coupler knuckle of claim 1, wherein the parting line is located approximately in a middle of the core.

6. A railcar coupler knuckle comprising:
a C-10 pin hole,
a top knuckle pulling lug,
wherein interior spaces of the railcar coupler knuckle are formed using a core comprising:
a rear core support configured to support the core when the core is assembled in a mold used to cast the railcar coupler knuckle;
a C-10 portion configured to form the C-10 pin hole in the railcar coupler knuckle;
a contoured surface configured to provide detail to the interior spaces of the railcar coupler knuckle; and
wherein the railcar coupler knuckle has a wall thickness that has a substantially constant thickness over a majority of the distance from the top of a front face of the top knuckle pulling lug to a bottom face of the top knuckle pulling lug.

7. The railcar coupler knuckle of claim 6, wherein the core further comprises a parting line defined on the contoured surface.

8. The railcar coupler knuckle of claim 7, wherein the parting line is defined along a direction extending from the rear core support to the C-10 portion.

9. The railcar coupler knuckle of claim 8, wherein at least a part of the C-10 portion being formed as a substantially cylindrical portion having a substantially circular cross-section.

10. The railcar coupler knuckle of claim 9, wherein the parting line substantially bisects the circular cross-section of the part of the C-10 portion being formed as the substantially cylindrical portion.

11. The railcar coupler knuckle of claim 9, wherein the C-10 pin hole has a draft angle of less than 3 degrees, as cast.

12. The railcar coupler knuckle of claim 9, wherein the top knuckle pulling lug has a wall thickness of between about 0.47" and 0.53" throughout an entirety of the top knuckle pulling lug.

13. A railcar coupler knuckle comprising:
a C-10 pin hole,
a top knuckle pulling lug,
wherein interior spaces of the railcar coupler knuckle are formed using a core comprising:
a rear core support configured to support the core when the core is assembled in a mold used to cast the railcar coupler knuckle;
a C-10 portion configured to form the C-10 pin hole in the railcar coupler knuckle, at least a part of the C-10 portion being formed as a substantially cylindrical portion having a substantially circular cross-section;
a contoured surface configured to provide detail to the interior spaces of the railcar coupler knuckle; and
a parting line defined on the contoured surface along a vertical direction of the core, wherein the vertical direction is a direction extending from the rear core support to the C-10 portion, and wherein the parting line substantially bisects the substantially circular cross-section of the part of the C-10 portion being formed as the substantially cylindrical portion, and
wherein the railcar coupler knuckle has a wall thickness from the top of a front face of the top knuckle pulling lug to a bottom face of the top knuckle pulling lug.

14. The railcar coupler knuckle of claim 13, wherein the C-10 pin hole has a draft angle of less than 3 degrees, as cast.

15. The railcar coupler knuckle of claim 13, wherein the top knuckle pulling lug has a wall thickness of between about 0.47" and 0.53" throughout an entirety of the top knuckle pulling lug.

16. The railcar coupler knuckle of claim 13, wherein the core includes a kidney portion, and wherein the kidney portion includes a first section that forms a top knuckle pulling lug of the railcar coupler knuckle.

17. The railcar coupler knuckle of claim 13, wherein the parting line is located approximately in a middle of the core.

* * * * *